US005988829A

United States Patent [19]

Holder

[11] Patent Number: 5,988,829

[45] Date of Patent: Nov. 23, 1999

[54] DIRECT/INDIRECT LIGHTING FIXTURES

[75] Inventor: Gregory Randal Holder, Conyers, Ga.

[73] Assignee: NSI Enterprises, Inc., Atlanta, Ga.

[21] Appl. No.: 08/901,264

[22] Filed: Jul. 28, 1997

[51] Int. Cl.[6] ..... F21S 1/02

[52] U.S. Cl. ..... 362/217; 362/223; 362/147; 362/307

[58] Field of Search ..... 362/307, 308, 362/364, 147, 217, 223, 355, 346, 297

[56] References Cited

U.S. PATENT DOCUMENTS

| | | | |
|---|---|---|---|
| 4,066,885 | 1/1978 | Weinberg | 362/18 |
| 4,933,821 | 6/1990 | Anderson | 362/208 |
| 4,991,063 | 2/1991 | Stoneham | 362/208 |
| 5,160,193 | 11/1992 | Fabbri et al. | 362/364 |
| 5,521,801 | 5/1996 | Pesau et al. | 362/147 |
| 5,813,743 | 9/1998 | Naka | 362/308 |

*Primary Examiner*—Thomas M. Sember
*Attorney, Agent, or Firm*—Kenneth E. Darnell

[57] ABSTRACT

Direct/indirect lighting fixtures particularly intended for recessed applications of fluorescent lighting for small offices and similar use environments where balanced illumination for both vertical and horizontal surfaces is necessary. The lighting fixtures of the invention include general lighting luminaires as well as wall wash luminaires, the present fixtures combining the efficient lighting capabilities of parabolic fluorescent lighting with the aesthetic appeal of indirect lighting to produce a visually appealing effect within an overall environment sufficiently illuminated for productive purposes. The general lighting luminaires of the invention combine two arcuate reflectors with intersecting curvatures, the line of intersection having illumination sources disposed on each side thereof and mounted to the reflectors in proximity to the line of intersection, the luminaires further including an arcuate diffuser centered about the line of intersection of the reflectors. Both direct and indirect light thus emanates from the luminaire. The diffuser is mounted within the luminaire to mechanical light trap elements located at either end of the diffuser, the light trap elements serving the dual purposes of minimizing light leakage and mounting the diffuser.

55 Claims, 17 Drawing Sheets

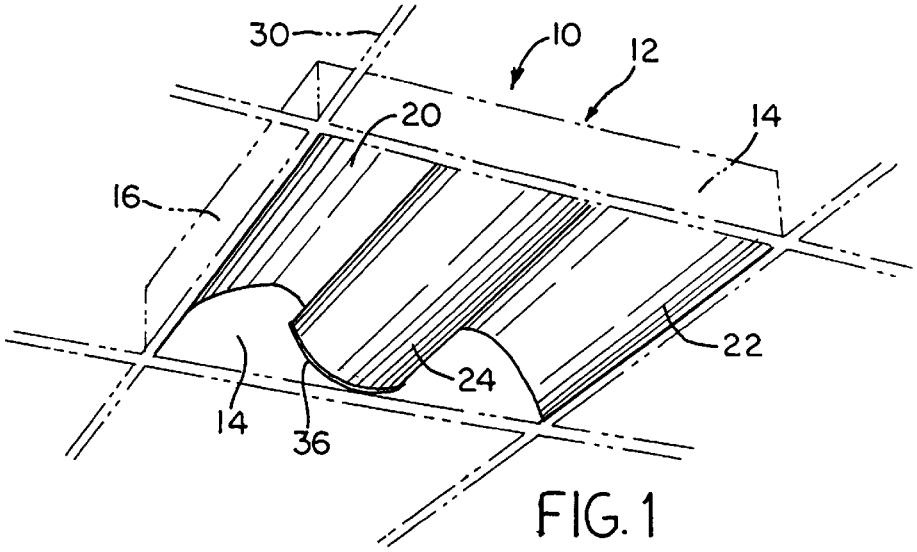
FIG. 1
FIG. 2
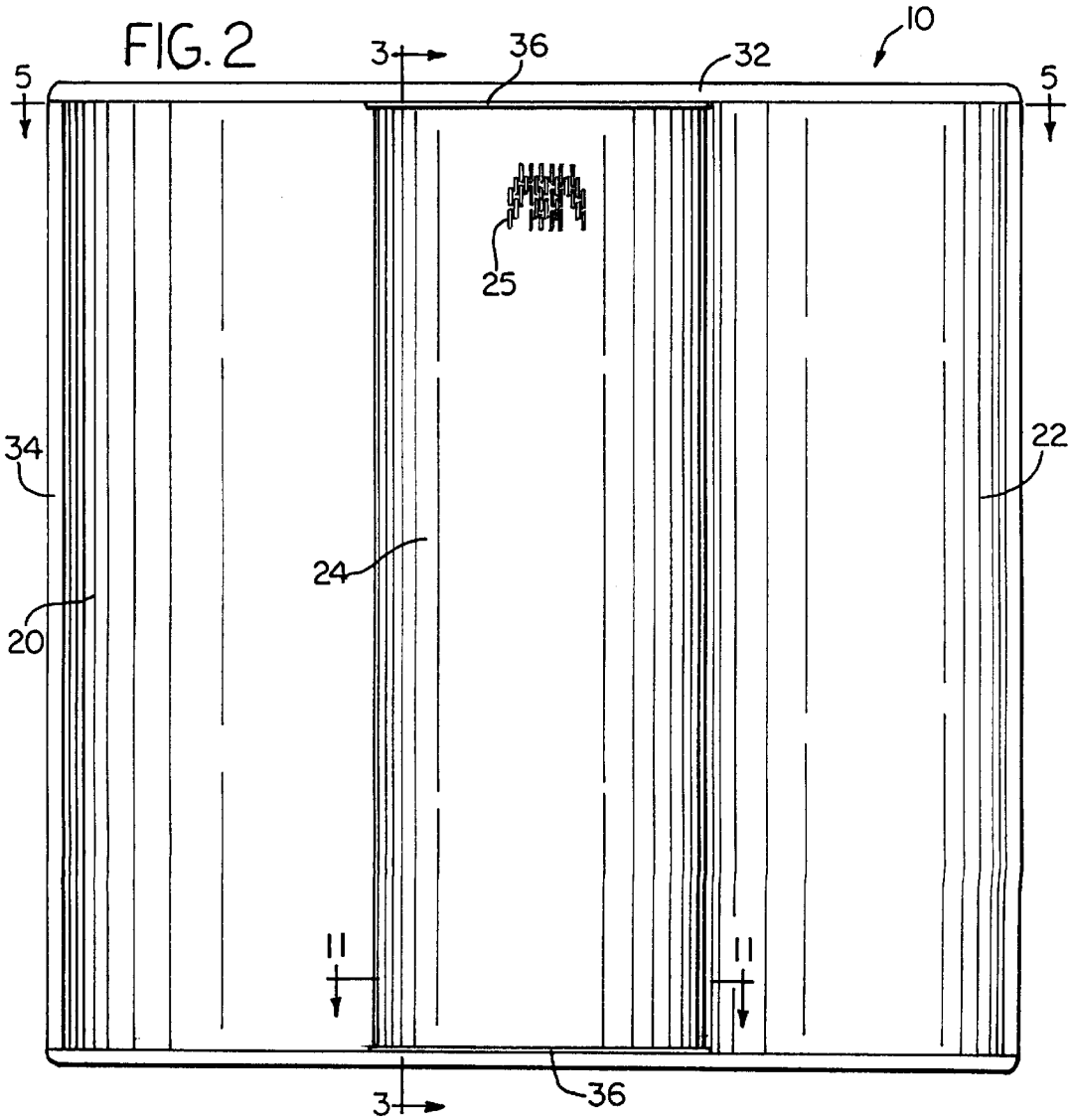

DIRECT/INDIRECT LIGHTING FIXTURES

BACKGROUND OF THE INVENTION

1. Field of the Invention

The invention relates generally to direct/indirect luminaire structures and particularly to recessed fluorescent lighting fixtures for providing visually appealing illumination of sufficient brightness to create a productive environment within a space such as a small office.

2. Description of the Prior Art

Lighting of commercial spaces including office environments and the like has become an almost exclusive province of modern fluorescent lighting systems, these systems usually taking the form of parabolic troffer fixtures capable of illuminating horizontal surfaces with a desired brightness level which allows a necessary productivity for those tasks being performed. While presently available fluorescent lighting systems are generally effective in accomplishing illumination goals in commercial spaces and particularly for large, relatively open spaces, a need exists within certain spaces including smaller office spaces and the like for a combination of the aesthetic appeal of indirect lighting, for example, with brightness levels conducive to productive activity. The lighting arts thus feel a need for luminaires capable of creating a more "soft" and appealing lighting environment while maintaining productive environments at reasonable system costs. Such lighting must provide balanced brightness with a necessary illumination of both vertical and horizontal surfaces in order to produce a necessary lighting quality and to enhance occupant satisfaction within the illuminated space. These requirements particularly come into play when lighting of relatively smaller office spaces is to be considered, such spaces requiring balanced brightness without production of the "cave" effect common to smaller spaces illuminated with high angle shielded luminaires. Often, smaller spaces illuminated with prior direct fluorescent luminaires suffer lighting contrasts including shadows and darker areas, especially on vertical wall surfaces, on the one hand and glare or harsh "hot" spots on both horizontal and vertical planes. Luminaires capable of maintenance of desired task-oriented illumination levels coupled with the "softness" or aesthetic appeal of indirect lighting, as an example, thus find utility in the art especially in smaller office environments and the like by creation of a feeling of spaciousness to occupants of the space. Such luminaires find greater utility when exhibiting design features which make an architectural statement additional to the creation of visual comfort.

A prior example of a luminaire intended to produce relatively high levels of luminous flux in an indirect fluorescent luminaire is provided by Bartenbach in U.S. Pat. No. 4,794,501. The luminaire of Bartenbach mounts a fluorescent tubular lamp within a channel-shaped counter-reflector, light from the illumination source being indirectly reflected from reflector elements disposed above the counter-reflector and opposing the illumination source. In the Bartenbach luminaire, light is not intended to pass through the counter-reflector. While the Bartenbach luminaire provides indirect lighting having a certain utility, the prior art has not previously provided luminaire structures capable of both direct and indirect lighting in a fluorescent system and which is capable of creating the visual advantages alluded to hereinabove and especially when considering luminaire appearance and system costs in environments such as the small office environment. Accordingly, the present invention is seen to provide a direct/indirect luminaire particularly intended for use with fluorescent illumination sources and which is capable of producing the advantages noted herein including desired light levels as well as desired lighting quality at reasonable cost and with exceptionally pleasing aesthetic appearance.

SUMMARY OF THE INVENTION

The invention provides direct/indirect lighting fixtures particularly intended for recessed applications of fluorescent lighting for small office and similar use environments where parabolic fluorescent lighting systems of the prior art typically do not provide the desirable combination of balanced lighting and aesthetic appeal of which the present lighting fixtures are especially capable. The present lighting fixtures not only provide balanced brightness levels conducive to productive activity, but also an evenness of illumination on both vertical and horizontal surfaces which contributes the visual comfort of an occupant of a space illuminated with one or more of the present lighting fixtures. The present lighting fixtures provide similarly effective task lighting within a small office space or the like while effectively removing the "cave" effect of typical parabolic lighting within small spaces, this "cave" effect being a distinct shadowing of wall surfaces extending downwardly from ceiling level. Such results are produced even without the incorporation of wall wash luminaires within a given system.

Both general lighting luminaires as well as wall wash luminaires can be configured according to the invention. The general lighting luminaires of the invention combine two arcuate reflectors with intersecting curvatures thus providing a line of intersection at the juncture of the reflectors. A general lighting luminaire configured according to the invention has illumination sources disposed on each side of this line of intersection with the illumination sources being effectively mounted to each reflector in proximity to this line of intersection. The luminaire further includes an arcuate diffuser centered about the line of intersection of the reflectors, with light from the illumination sources which impinges upon the diffuser being partially passed as direct light with a certain percentage of that light being reflected to the surmounting arcuate reflectors for reflection into the space to be illuminated as indirect light. A certain percentage of light from the illumination sources directly impinges upon the respective arcuate reflectors and is directed into the space as indirect light. Wall wash luminaire structures essentially comprising one-half of the structure of a general lighting luminaire according to the invention are also provided by the invention for wall washing within spaces wherein a wall washing capability of a both direct and indirect nature is needed. The wall wash luminaires of the invention also exhibit the attractive appearance of the general lighting luminaires of the invention and thus provide a similar architectural statement whether or not used in a system with the general lighting luminaires of the invention.

In both general lighting and wall wash luminaire structures of the invention, diffuser structure is mounted within the luminaire structures to light trap elements located on opposite walls of the luminaire for the dual purposes of minimizing light leakage from the ends of the diffusers and of mounting the diffusers within the fixtures. The light trap elements further mount the diffusers in partially open positions to allow maintenance and relamping.

Accordingly, it is an object of the invention to provide direct/indirect lighting fixtures particularly intended for recessed application of fluorescent lighting in small office and similar use environments.

It is another object of the invention to provide fluorescent fixtures capable of direct and indirect illumination of vertical and horizontal surfaces within a space to combine the aesthetic appeal of indirect lighting with brightness levels conducive to productive activity.

It is a further object of the invention to provide aesthetically pleasing direct/indirect lighting fixtures having efficient mechanical structure which contributes to both the aesthetic and illumination qualities of the fixtures while producing operational advantages.

Further objects and advantages of the invention will become more readily apparent in light of the following detailed description of the preferred embodiments.

BRIEF DESCRIPTION OF THE DRAWINGS

FIG. 1 is a perspective view of a general lighting fixture according to the invention shown recessed into a ceiling;

FIG. 2 is a bottom view looking directly up into the fixture of FIG. 1;

DESCRIPTION OF THE PREFERRED EMBODIMENTS

Figure 3:
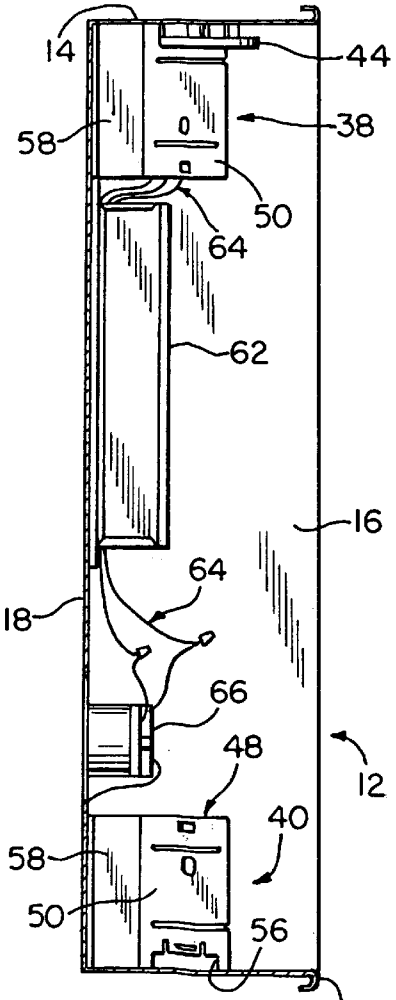
FIG. 3 is a side elevational view in section taken along the line 3—3 of FIG. 2 with the reflectors, basket and light trap removed.

Referring now to the drawings and particularly to FIGS. 1 and 2, a direct/indirect lighting fixture configured according to the invention is seen generally at 10 to comprise a housing 12 formed of opposing end walls 14, opposing side walls 16 and a top wall 18 as can best be seen in FIG. 3 inter alia. The end walls 14 each have portions of inner surfaces 15 which are visible when the fixture 10 is installed in a recessed situation as seen in FIG. 1. The lighting fixture 10 is further provided with arcuate reflectors 20 and 22 which are mounted within the housing 12 as will be described in detail hereinafter. As will be seen clearly in figures yet to be described, the reflectors 20 and 22 effectively join together to form a juncture not seen in FIGS. 1 and 2 due to the presence of a diffuser 24 which is centrally disposed within the housing 12 and located in a laterally symmetrical arrangement relative to the juncture of the reflectors 20 and 22.

Figure 21:
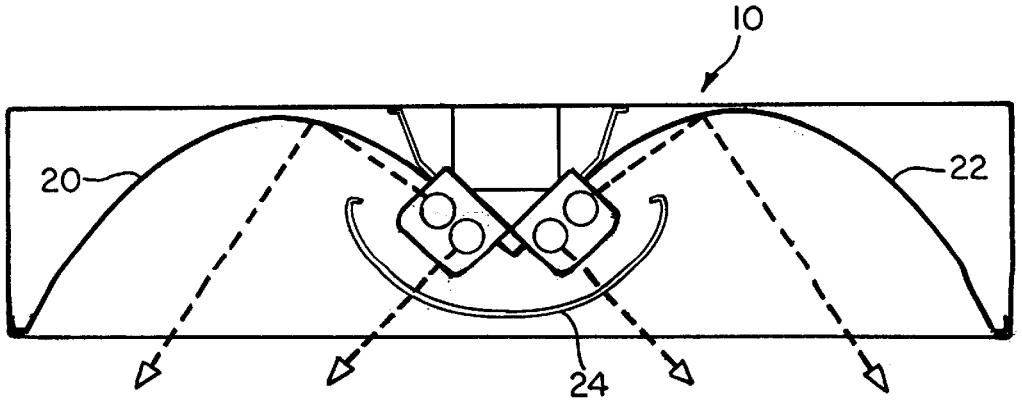
FIG. 21 is a diagram illustrating light emanating from the illumination sources of the embodiment of the invention of FIG. 1 inter alia.
Figure 23:
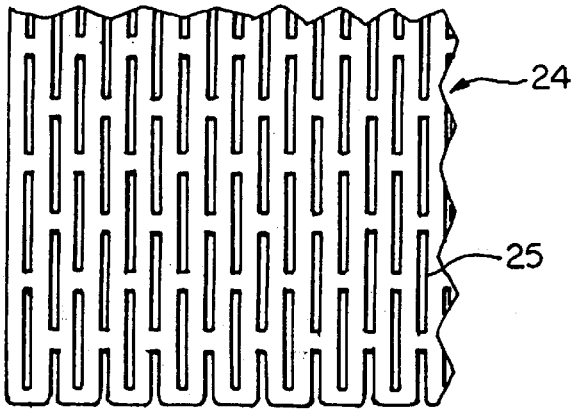
FIG. 23 is a detail view of a portion of a slotted diffuser formed according to the invention.
Figure 24:
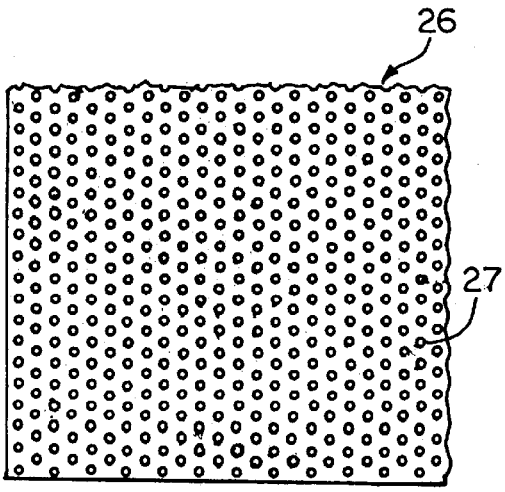
FIG. 24 is a detail view of a portion of a circular aperture perforated diffuser according to the invention.

As seen in FIG. 2 in particular, the diffuser 24 is seen to be provided with slots 25 which are illustrated in detail in FIG. 23, the slots 25 perforating the surface of the diffuser 24 over those arcuate body portions thereof which are visible as seen in FIGS. 1 and 2. For ease of illustration, the diffuser 24 having the slots 25 formed therein is utilized to describe the several embodiments of the invention. However, it is to be noted that a diffuser 26 perforated with round perforations 27 as shown in FIG. 24 could be utilized in place of the diffuser 24. Still further, a diffuser 28 formed as a linear prismatic acrylic lens 29 can be used according to the structure seen in FIGS. 25 through 27. The essential structures of the three diffusers 24, 26 and 28 are identical as to mechanical function as will be described in more detail hereinafter. Further, the optical functions of the diffusers 24, 26 and 28 are similar especially as regards the perforated diffusers 24 and 26 respectively having the slots 25 and round perforations 27 formed therein. In the perforated diffusers 24 and 26, light emanating from an illumination source, as will be described hereinafter, passes through either the slots 25 or the round perforations 27 and directly illuminates a space below the lighting fixture 10 as can be appreciated from a review of the diagram of FIG. 21. A certain percentage of the light incident on interior surfaces of the diffusers 24 and 26, that is, that light not passing through the perforations, is reflected against one or the other of the arcuate reflectors 20 and 22 and then indirectly reflected into the environmental space. A certain percentage of the light emanating from illumination sources mounted within the fixture 10 directly impinges one or the other of the arcuate reflectors 20 and 22 and is thus reflected into the environmental space as indirect lighting as can be appreciated from a consideration of FIG. 21.

In the recessed mounting arrangement of FIG. 1, a conventional grid is seen at 30 for mounting of the lighting fixture 10. A mounting arrangement such as the grid 30 can take a variety of forms such as are conventional in the art. As can be seen in FIG. 2, outwardly bent flange-like channels 32 terminate lower edges of the end walls 14 while inwardly directed flanges 34 terminate the side walls 16, the channels 32 and the flanges 34 providing structure which can be placed against surfaces of the grid 30 in a conventional fashion to mount the lighting fixture 10 to the grid 30.

The diffuser 24 is removably mounted within the lighting fixture 10 by means of light trap mounting elements 36 which are disposed one each on each of the end walls 14 as will be described in detail hereinafter. The light trap mounting elements 36 not only act to mount the diffuser 24 within the fixture 10 in both fully seated and partially open maintenance modes, but also acts to reduce light escaping from the fixture 10 at the ends of the diffuser 24.

Referring now to FIGS. 3, 4, 7 and 10, the housing 12 is seen with the arcuate reflectors 20 and 22 as well as the diffuser 24 removed in order that those portions of the fixture 10 necessary to operation of the fixture yet not visible in a fully assembled condition can be appreciated. As is seen in the drawings, lamp holder brackets 38 and 40 are seen to be mounted to inner wall surfaces of the top wall 18 in a conventional manner, the brackets 38 and 40 being essentially identical in structure even though only the bracket 38 is utilized to mount lamp sockets 42 and 44. Both of the brackets 38 and 40 are provided with cutouts 46 which would enable mounting of the sockets 42, 44. In view of inventory considerations, however, both of the brackets 38 and 40 are identically formed. The cutouts 46 in the bracket 40 will thus be superfluous. A description of one of the brackets 38 or 40 will accordingly suffice for a description of both. Considering then the bracket 38, a V-shaped body portion 48 is formed of bent stock to an angle defined by body plates 50 which will accommodate mounting of the reflectors 20, 22. The plates 50 have the cutouts 46 arranged along outwardly disposed edges thereof, the cutouts 46 being essentially rectangular in shape with two spaced, inwardly extending slot portions 52 extending from the defined lengthwise edge of said cutout 46. The cutouts 46 thus accommodate one each of the lamp sockets 42 or 44. A rounded slot 54 and a rectangular slot 56 is formed in each of the body plates 50 for purposes to be described hereinafter. The body plates 50 bend inwardly away from the planes of the plates 50 to form leg portions 58 which terminate in flange elements 60 which can receive fasteners in a conventional manner to mount the brackets 38, 40 to the top wall 18.

Inwardly of the lamp holder brackets 38, 40 is disposed a ballast 62 which joins electrically through wiring 64 to a power socket 66 which receives power for operation of the fixture 10. The ballast 62 and the power socket 66 are mounted to the top wall 18 of the housing 12 in a conventional manner. The wiring 64 is seen to extend to the lamp sockets 42 and 44 through that space defined by the bracket 38 and opposing wall surfaces of the top wall 18 to which the bracket 38 is mounted.

Figure 4:
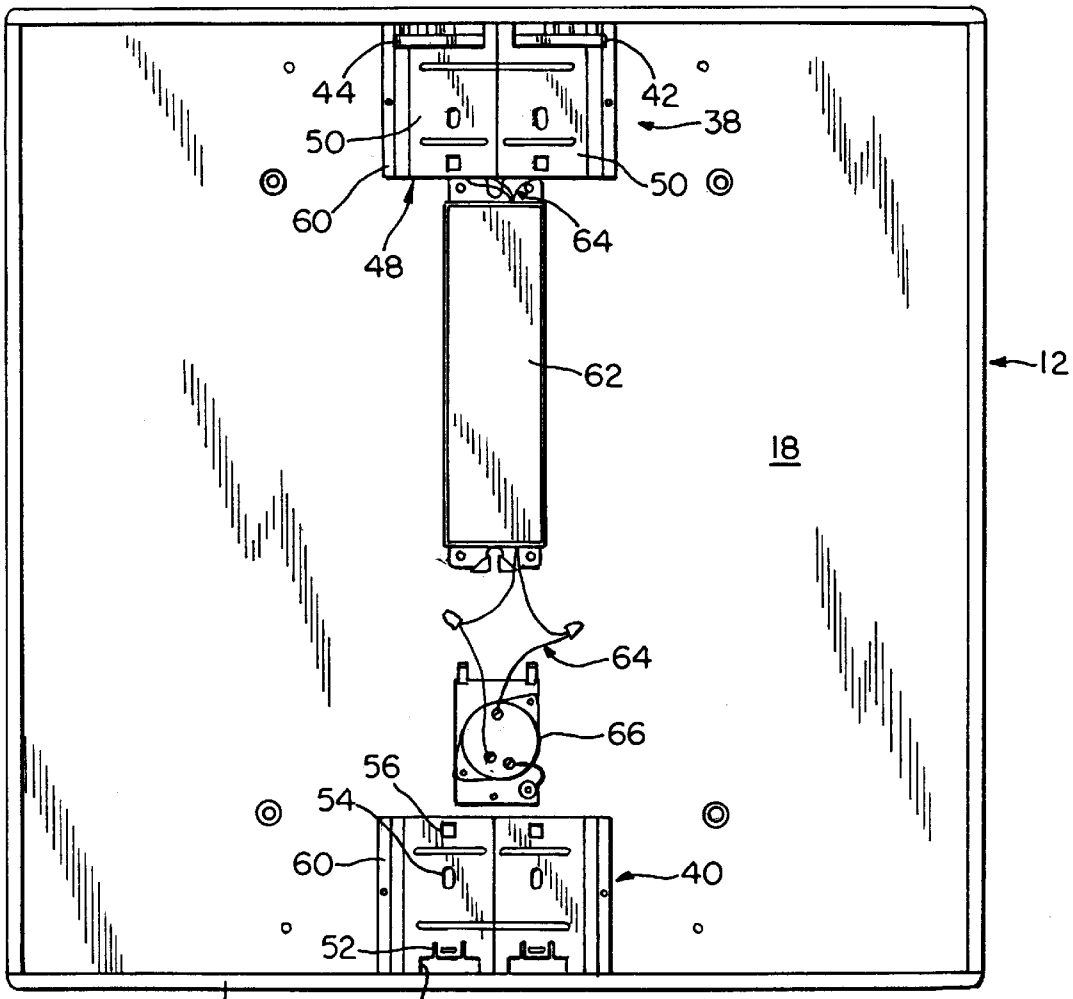
FIG. 4 is a bottom view of the lighting fixture with the reflectors, basket and light traps removed.
Figure 5:
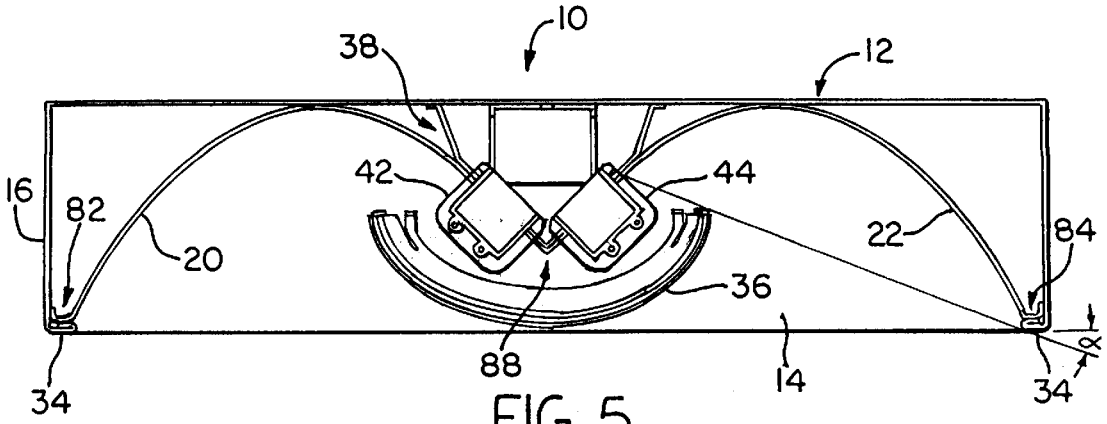
FIG. 5 is an end elevational view in section taken along the line 5—5 of FIG. 2.
Figure 6:
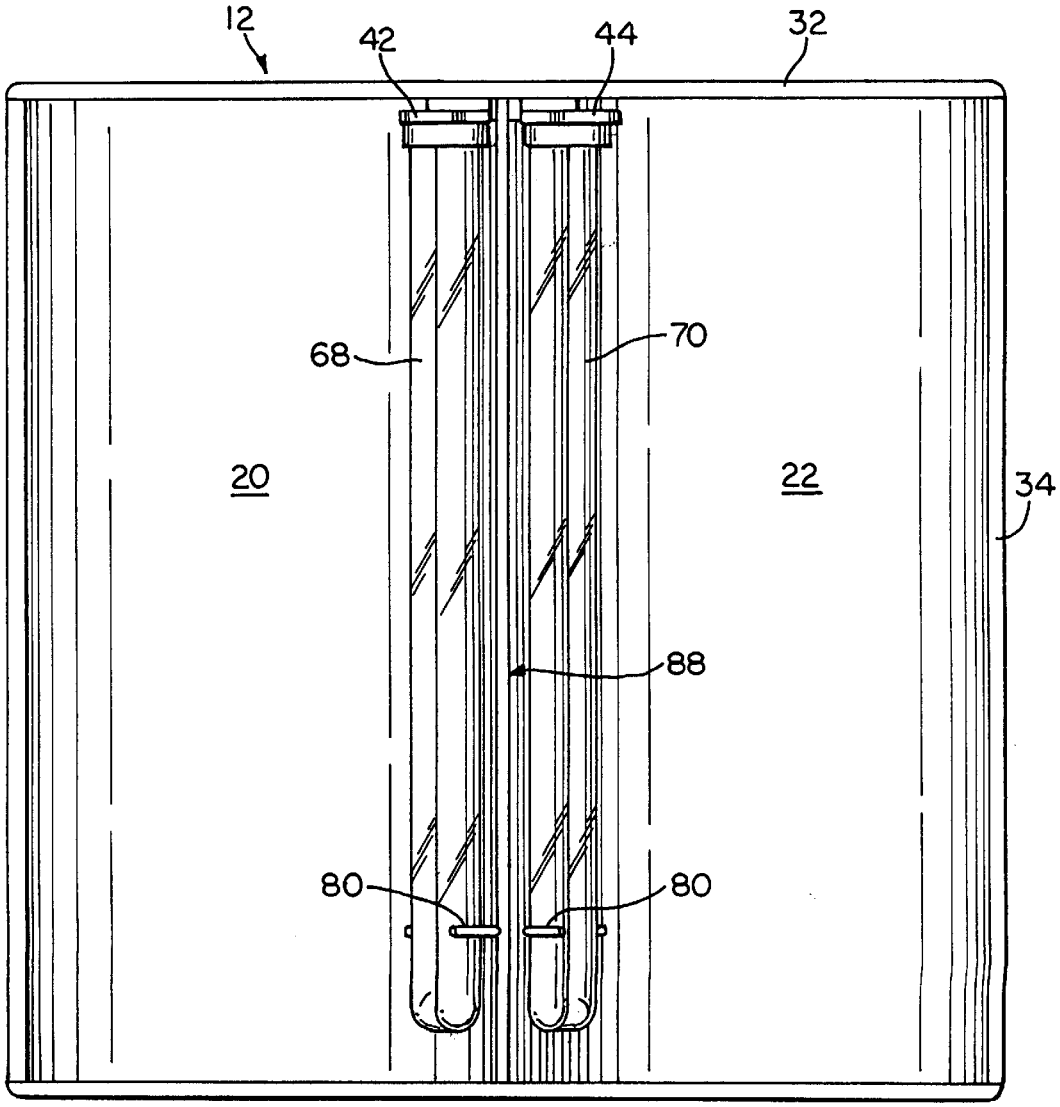
FIG. 6 is a bottom view of the light fixture of FIG. 2 with the basket and light trap removed.
Figure 7:
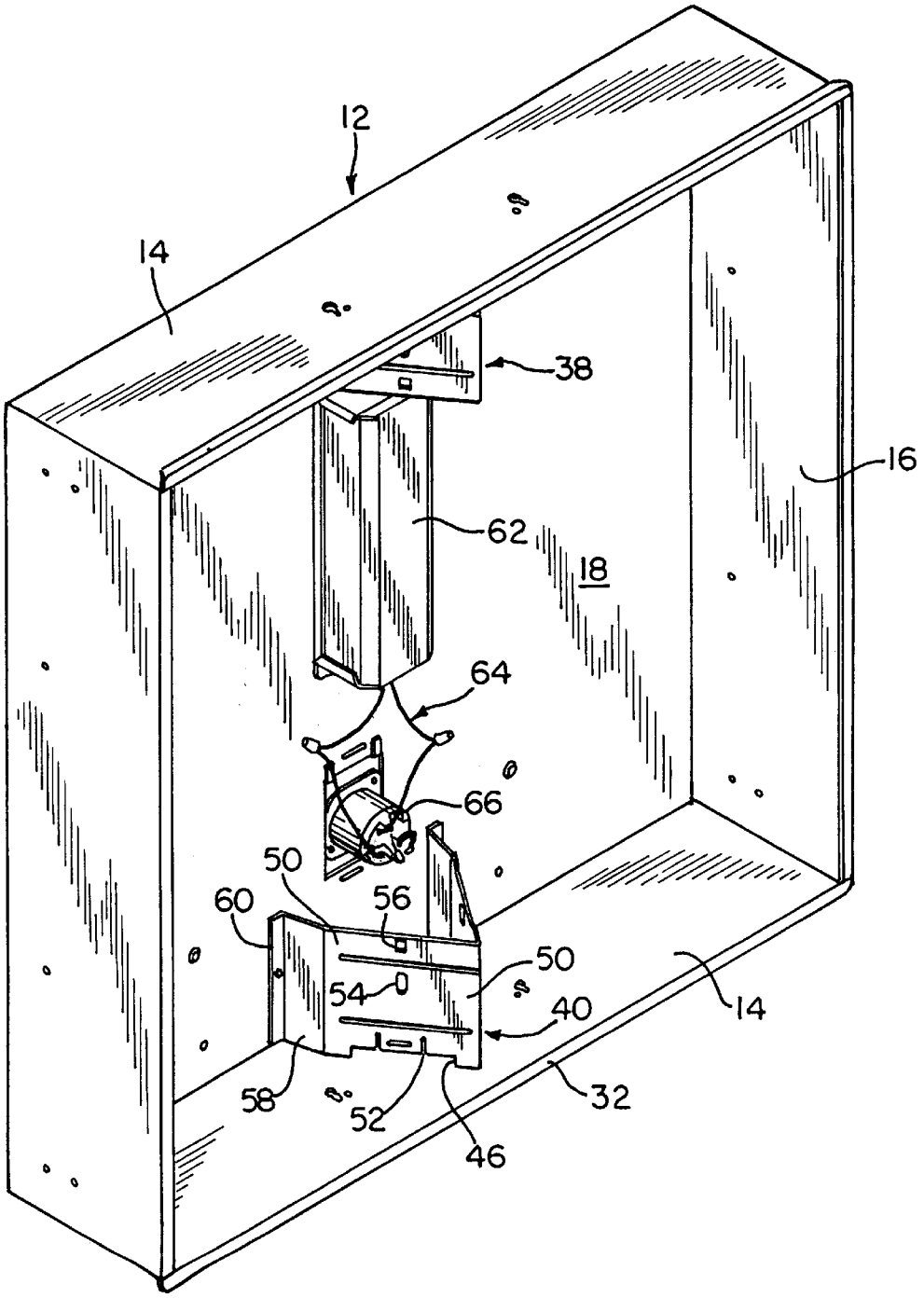
FIG. 7 is a perspective view of the structure shown in FIG. 4.
Figure 8:
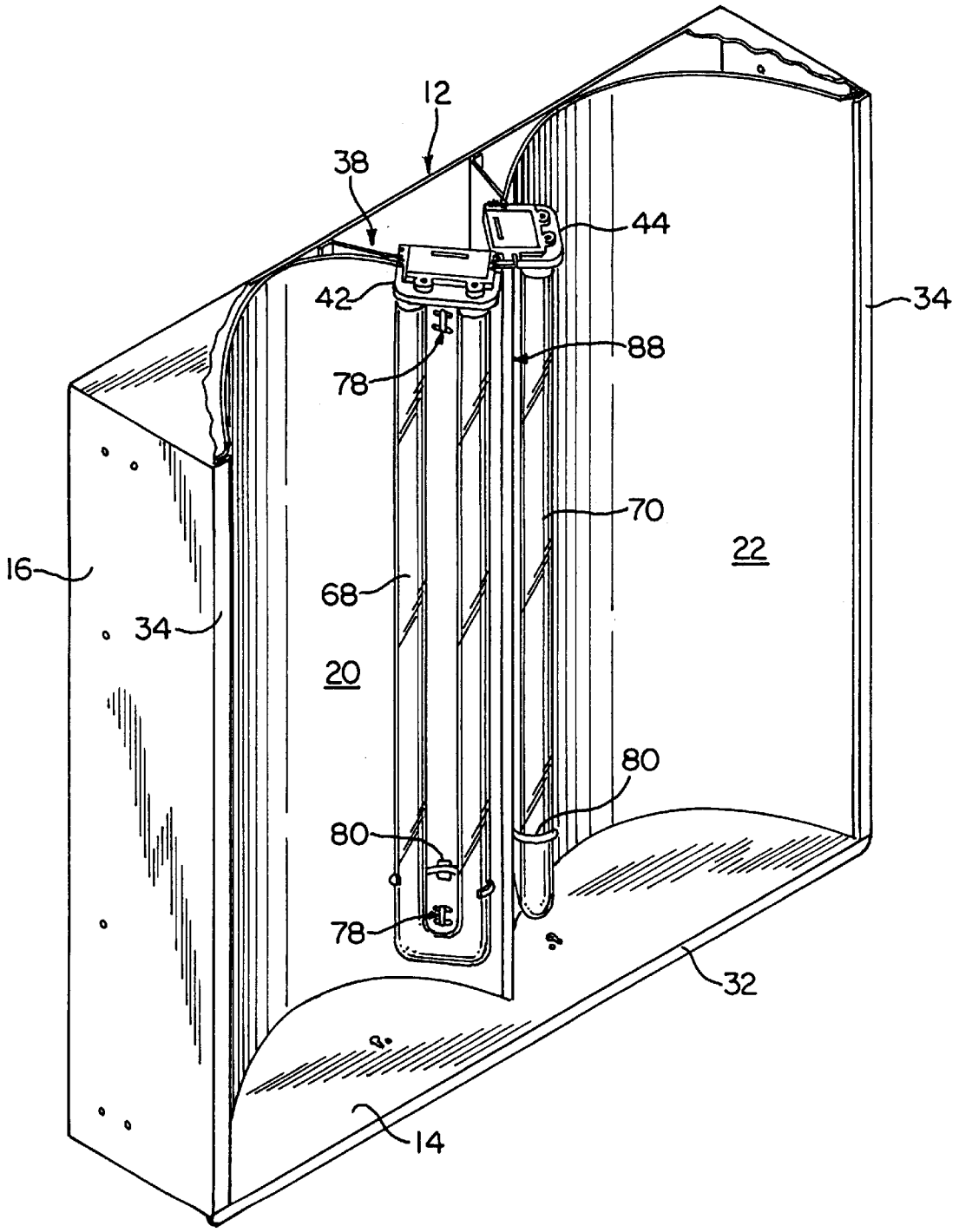
FIG. 8 is a perspective view, partially cut away, of the fixture housing of FIG. 7 with the reflectors and illumination sources as well as associated illumination source mounting structure shown in an assembled relationship.

Referring now to FIGS. 5, 6, 8 and 10, the housing 12 and associated structure described with reference to and shown in FIGS. 3, 4 and 7 are seen to have assembled thereto the arcuate reflectors 20 and 22 with lamps being operatively mounted by the lamp sockets 42 and 44. In FIG. 5, it is further seen that one of the light trap mounting elements 36 is mounted to one of the end walls 14.

Figure 10:
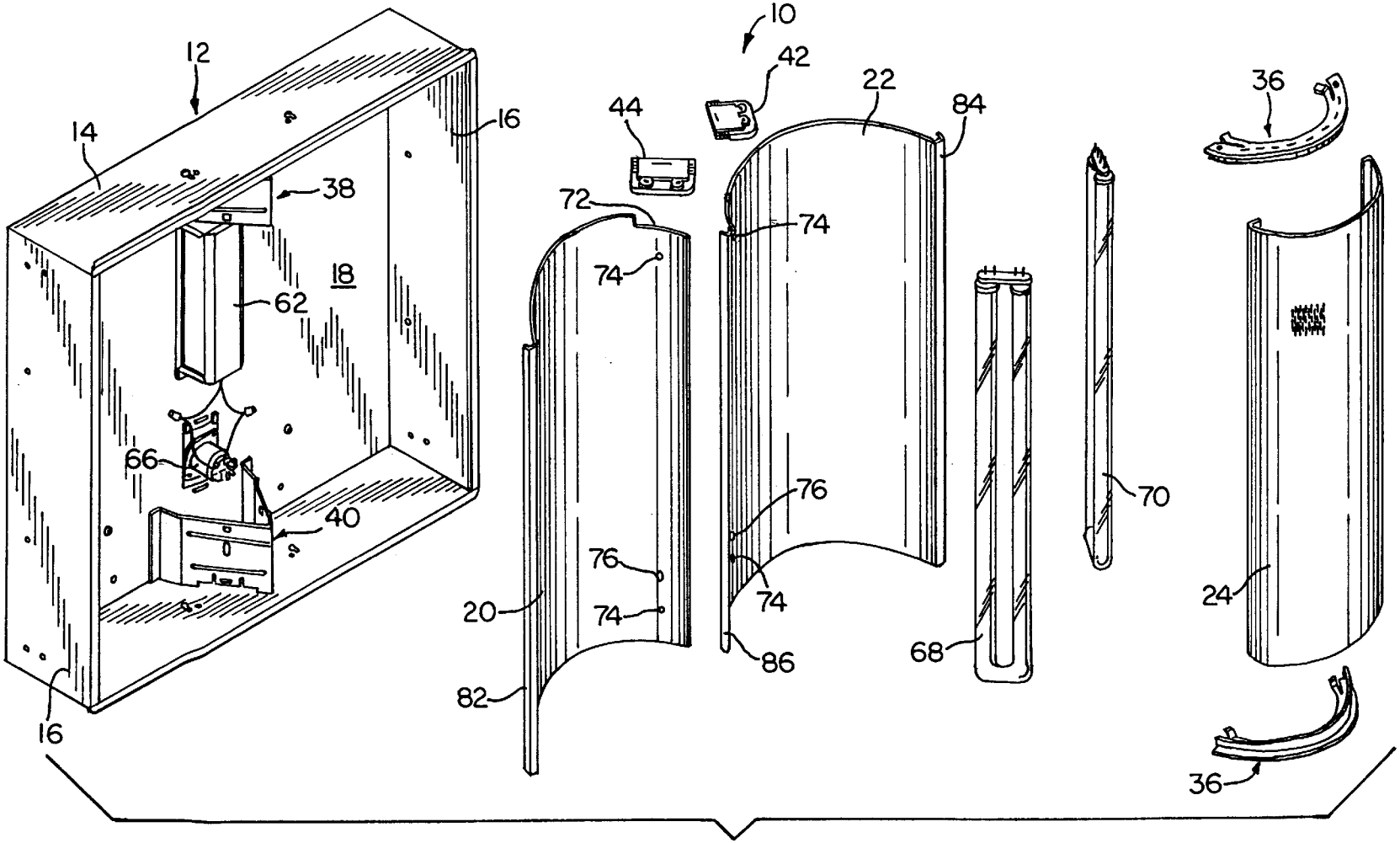
FIG. 10 is a partially exploded view of the lighting fixture having a housing including mounting structure and the like as shown in FIG. 7.

As best seen in FIG. 10, each of the arcuate reflectors 20 and 22 are provided with cutouts 72 through which the lamp sockets 42 and 44 respectively extend to allow the reflectors 20, 22 to be mounted within the housing 12 with portions of the reflectors 20, 22 being disposed adjacent to and mounted to the body plates 50 of the respective brackets 38, 40. As is best seen in FIG. 10, each of the reflectors 20, 22 have circular apertures 74 formed along one edge thereof, that edge being surmounted by one of the cutouts 72. Adjacent the circular aperture 74 on that end of the reflectors 20, 22 opposite the cutout 72 and inwardly of the aperture 74, is formed a rectangular aperture 76. The circular aperture 74 receives twist and lock fasteners 78 therethrough, a lower portion of the fastener 78 being received into the rounded slot 54 formed in each of the brackets 38, 40, thereby to releasably mount the reflectors 20, 22 to the brackets 38, 40. A U-shaped cradle fastener 80 is received in each of the rectangular apertures 76 to hold and stabilize the respective lamps 68, 70 at distal ends thereof. Portions of the fasteners 80 extending from those sides of the reflectors 20, 22 opposite the lamp side thereof are received into the rectangular slots 56 respectively formed in the brackets 38, 40 to provide clearance.

As is also seen in FIG. 10, the arcuate reflector 20 is provided with a channel-like flange 82 along an outer edge thereof, the inner edge of the reflector 20 being unbent. The arcuate reflector 22 is similarly provided with a channel-like flange 84 along its outer lateral edge and is provided at its inner edge with a planar flange 86. The channel-like flanges 82 and 84 respectively are received against the respective flanges 34 which terminate the side wall 16 of the housing 12 as is best seen in FIG. 5. Due to the resiliency of the reflectors 20, 22, the channel-like flanges 82, 84 provide a sufficient tension fit against the flanges 34 and against adjacent inner wall portions of the side wall 16. At the juncture of the reflectors 20, 22 centrally of the housing 12, that is, at the locations where the reflectors 20, 22 are mounted to the brackets 38, 40, the planar flange 86 of the reflector 22 effectively extends over straight edge portions of the reflector 20 to provide a continuous reflective surface. The reflector 22 is bent to form the planar flange 86 at an angle which is essentially identical to the angle between the body plates 50 of each of the brackets 38, 40, this angle also being that angle at which the reflectors 20, 22 come together along a juncture line 88 essentially forming a dihedral angle of 90°.

The lamps 68, 70 are preferably T5 bi-tube fluorescent lamps of a desired wattage such as 40W or 50W, the nominal lengths of the lamps 68, 70 in the fixture 10 being essentially 24 inches. It is to be understood that other types of lamps and wattages can be employed. Such lamping is conventionally available from manufacturers such as the General Electric Corporation, Philips, Osram and Sylvania. Such lamping is expected to exhibit a lamp life of from 12,000 to 20,000 hours depending on lamp wattage.

The reflectors 20, 22 are typically provided with a white paint finish of high reflectivity as is conventional in the art. Interior walls of the housing 12 are similarly provided with a reflective white paint, especially the walls 14. In practice, essentially the entire housing 12 is so painted. Painting of the housing 12 typically occurs after forming of the housing and conventional riveting of corners. The lighting fixture 10 is nominally 2 feet square with a height of approximately 51 inches. Various options in the choice of conventional electronic ballasts, emergency battery packs (not shown), internal fusing (not shown) and the like are conventionally provided in the fixture 10 as desired. Operating voltages are typical voltages such as 120, 277, 347 and the like. The housing 12 and structure associated therewith are preferably formed of metal stock of conventional thicknesses, the gauge of such stock typically being 22 gauge. The lamp holder brackets 38, 40 can be provided with strengthening beads as seen at 90 and 92 in order to provide added strength to that structure.

Figure 9:
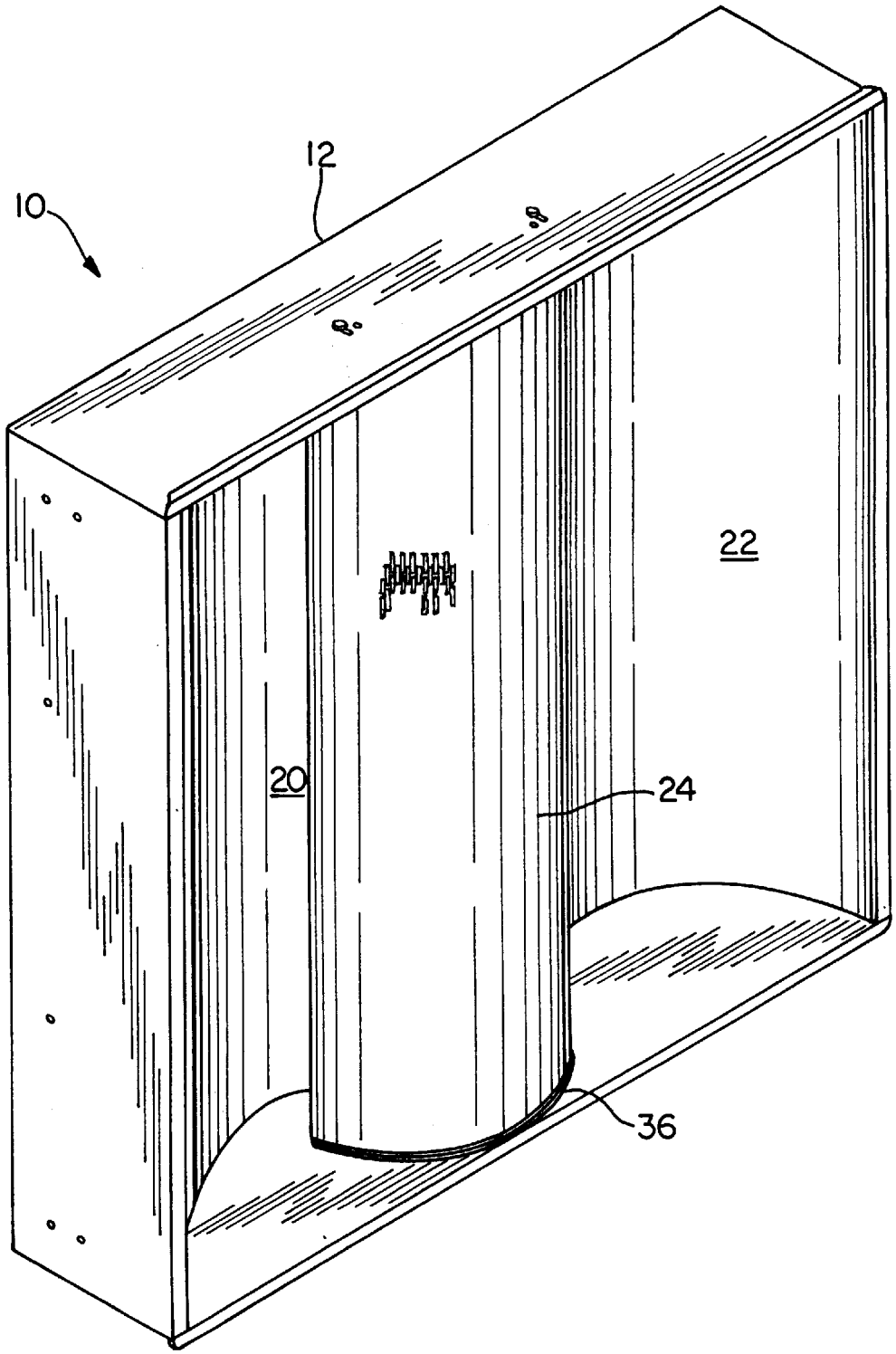
FIG. 9 is a perspective view of a completely assembled lighting fixture according to the invention.
Figure 26:
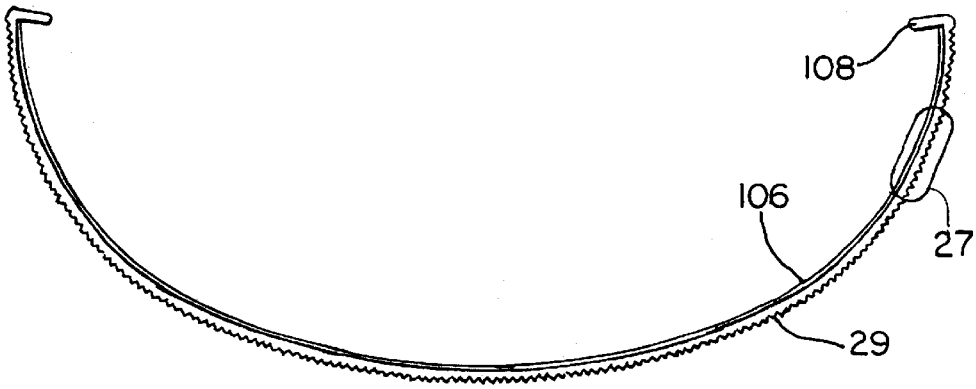
FIG. 26 is an end view of a portion of the diffuser of FIG. 25.
Figure 27:
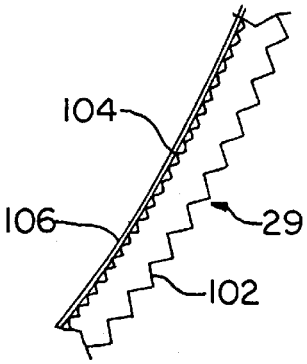
FIG. 27 is a detail view of a portion of the diffuser element of FIG. 26.
Figure 25:
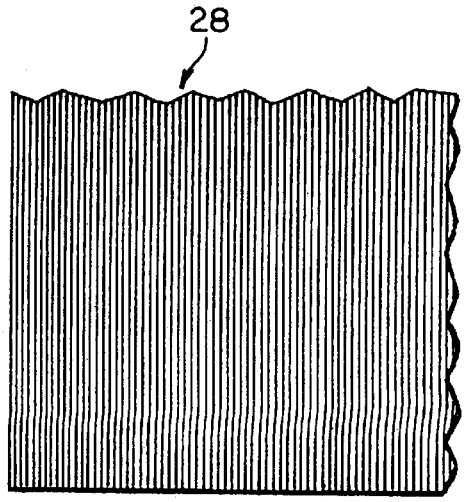
FIG. 25 is a detail view of a portion of a prismatic diffuser according to the invention.

As can be seen in FIG. 7 inter alia, the end walls 14 of the housing 12 are each provided with spaced compound apertures 94, each compound aperture 94 having a circular aperture 96 located essentially immediately inwardly thereof and aligned with a U-shaped aperture portion which extends from main body aperture portion 100 of each of the compound apertures 94. The mounting of the light trap mounting elements 36 to the apertures 94, 96 will be described in detail hereinafter. However, it is to be seen in FIG. 9, as an example, that the light trap mounting elements 36 are mounted to the housing 12 with the diffuser 24 then being mounted by the light trap mounting elements 36 to effectively form the completed lighting fixture 10 of the invention. The diffuser 24 is formed of metal stock which is perforated to produce the slots 25 which are best seen in FIG. 23 as previously mentioned. The diffusers 26, 28 could be similarly mounted within the light fixture 10 as seen in FIG. 9 inter alia primarily to provide differing decorative function. The diffuser 28 having the prismatic lens 29 shown best in FIGS. 25 through 27 provides a fixture appearance differing from the perforated metal structures of the diffusers 24 and 26. As seen in FIGS. 25 through 27, the prismatic lens 29 is provided with prismatic facets 102 on an outward side thereof and smaller facets 104 on an interior side thereof. The diffusers 24, 26 and 28 have a diffusing sheet 106 carried thereby, the sheet 106 effectively having the same shape. The diffusing sheet 106 is formed of an acrylic material of approximately $^{20}/_{1000}$ inch thickness by Flexilume of Memphis, Tenn. The diffuser 24, 26 and 28 are further provided with inwardly directed mounting flanges 108 along lateral edge portions thereof as will further be described hereinafter. For convenience of illustration, the sheet 106 is not shown in FIGS. 5 and 10.

Referring now to FIGS. 11, 12, 13 and 14A and 14B, inter alia, the light trap mounting elements 36 are seen to be identical in structure, comprising an arcuately curved planar body portion 120 having a curved mounting flange 122 extending inwardly therefrom along the full arcuate length of said body portion 120. Preferably, the elements 36 are formed of UV stablized polystyrene. The flange 122 is spaced from lowermost edges of the body portion 120. Arcuate cutouts 124 formed in each end of the body portion 120 define arcuate fingers 126 which each terminate in an inwardly directed tab 128. On the opposite side of the light trap elements 36, a raised circular boss 130 is seen to be provided on each of the fingers 126 at and immediately below the location of the tabs 128. Each circular boss 130 has an upper planar portion 132 which is angled relative to the plane in which the finger 126 lies, the boss 130 thus being thicker nearmost the tab 128. Each end of the body portion 120 has extending therefrom a cylindrical neck-like projection 134 which is slightly flattened nearmost the end of the body portion 120, the projection 134 terminating in a circular button 136.

Figure 12:
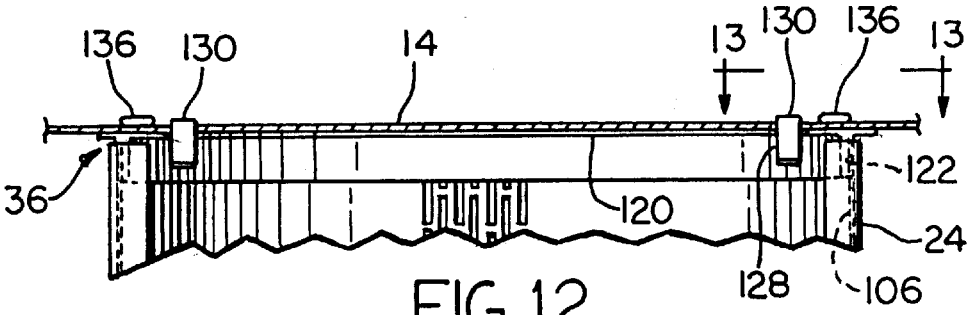
FIG. 12 is a section taken through lines 12—12 of FIG. 11.
Figure 13:
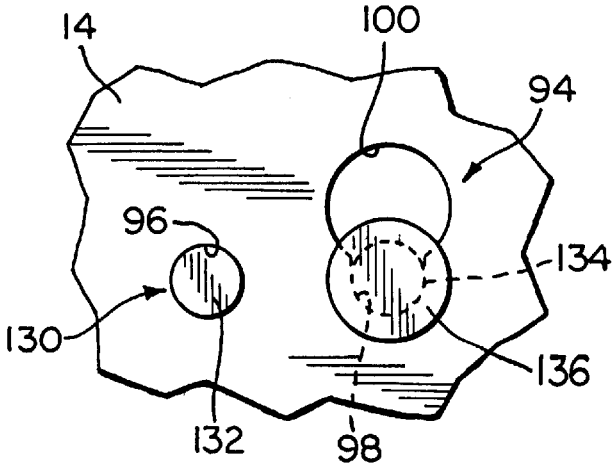
FIG. 13 is an enlarged detailed view taken generally along lines 13—13 of FIG. 12.
Figure 14A:
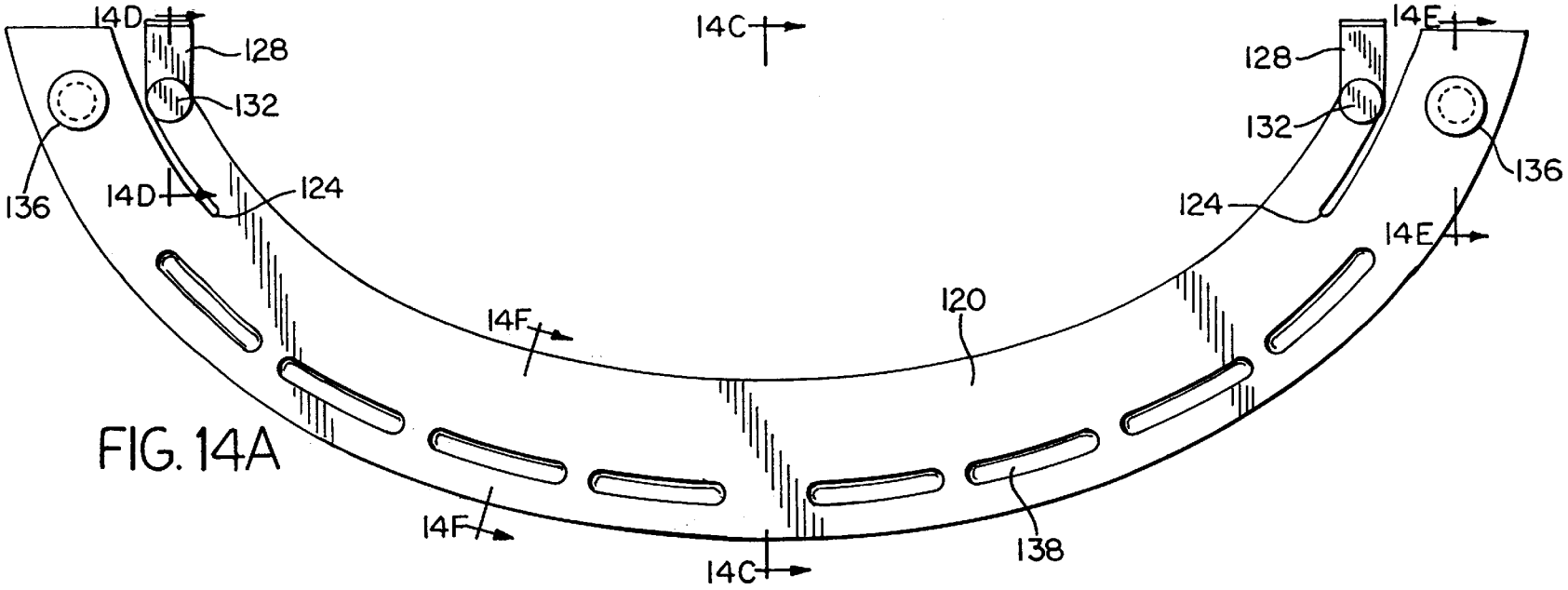
FIGS. 14A through 14F are elevational views of a light trap element illustrating the structure of the light trap element.
Figure 14B:
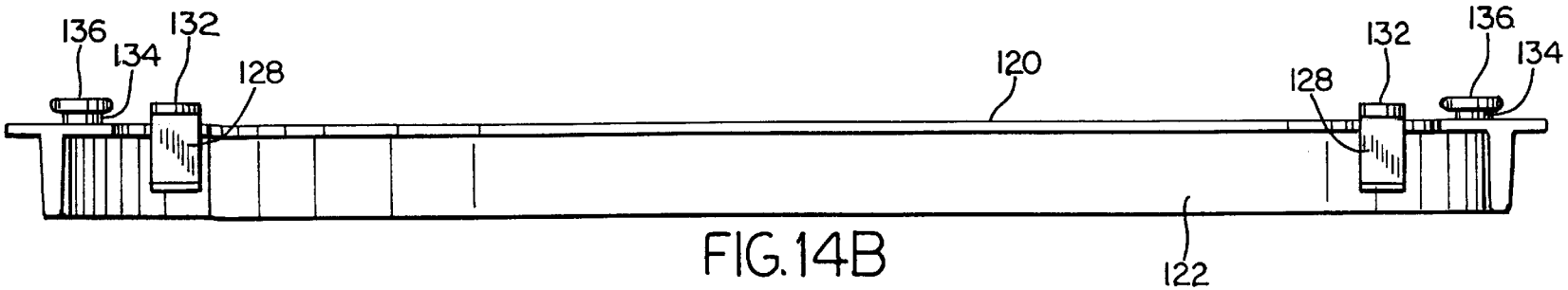
Figure 14C:
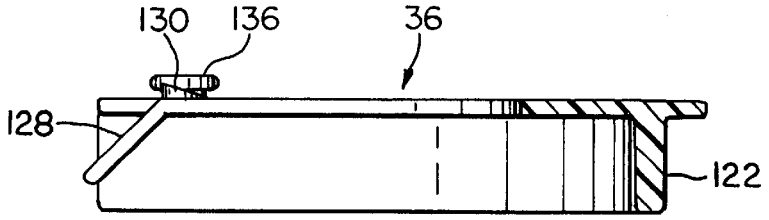
Figure 14F:
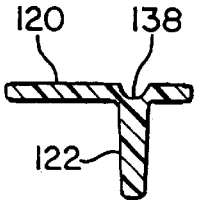
Figure 14D:
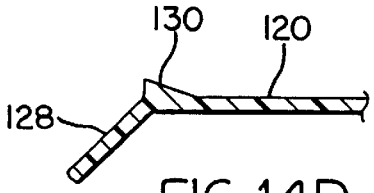
Figure 14E:
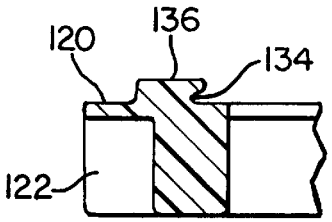

As is best understood with reference to FIGS. 12 and 13, the buttons 136 are respectively inserted into portions 100 of the compound apertures 94, the portions 100 being circular and of a slightly greater diameter to allow the buttons 136 to be received therethrough. The light trap mounting elements 36 are then moved downwardly to cause the neck-like projections 134 to be received into the U-shaped aperture portions 98 of the compound apertures 94, thereby to mount the elements 36 in place since the diameter of the buttons 136 are too great to pull through the aperture portions 98. When so positioned, each circular boss 130 snap-fits into the respective circular aperture 96 to further secure the mounting elements 36 in place. The tabs 128 can be manually biased outwardly of the end wall 14 to disengage each boss 130 from each of the apertures 96 with the mounting element 36 then being moved toward the top wall 18 to align the buttons 136 with the respective aperture portions 98 so that the mounting elements 36 can be rapidly disengaged from the end wall 14 and removed from the fixture 10. Rapid access is thus gained to the portion of the fixture containing the ballast inter alia.

Figure 11:
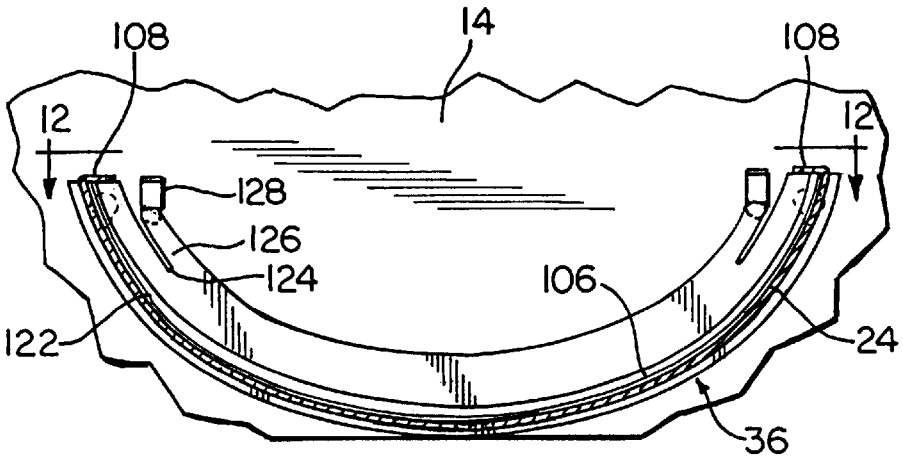
FIG. 11 is an end elevational view in section taken along lines 11—11 of FIG. 2.

As can be seen in FIG. 11 and FIG. 12 inter alia, ends of the diffuser 24 fit about the curved mounting flange 122 with edges of the diffuser 34 essentially abutting against planar portions of the body portion 120 of each said element 36, outer wall portions of the mounting flange 122 abutting against inner perimetric wall surfaces disposed about endmost edges of the diffuser 24, thereby to provide an effective light trap function. The mounting flanges 108 respectively fit over ends of the mounting flange 122 to hold the diffuser 24 in place on the mounting elements 36. One of the mounting flanges 108 can be snapped from one end each of the mounting elements 36 with the diffuser 24 then being allowed to hang down from the fixture 10 through connection of the other mounting flange 108 to opposite ends of the elements 36 in order to gain access to either the lamp 68 or the lamp 70 for purposes of relamping or other maintenance, the entire diffuser 24 thus swinging downwardly from the fixture 10 to provide access to both of the lamps 68, 70. Curved indentations 138 seen in FIG. 14 can be disposed in an arcuate pattern on outwardly facing surfaces of the body portion 120 of the mounting elements 36 as a manufacturing expedient.

Figure 15:
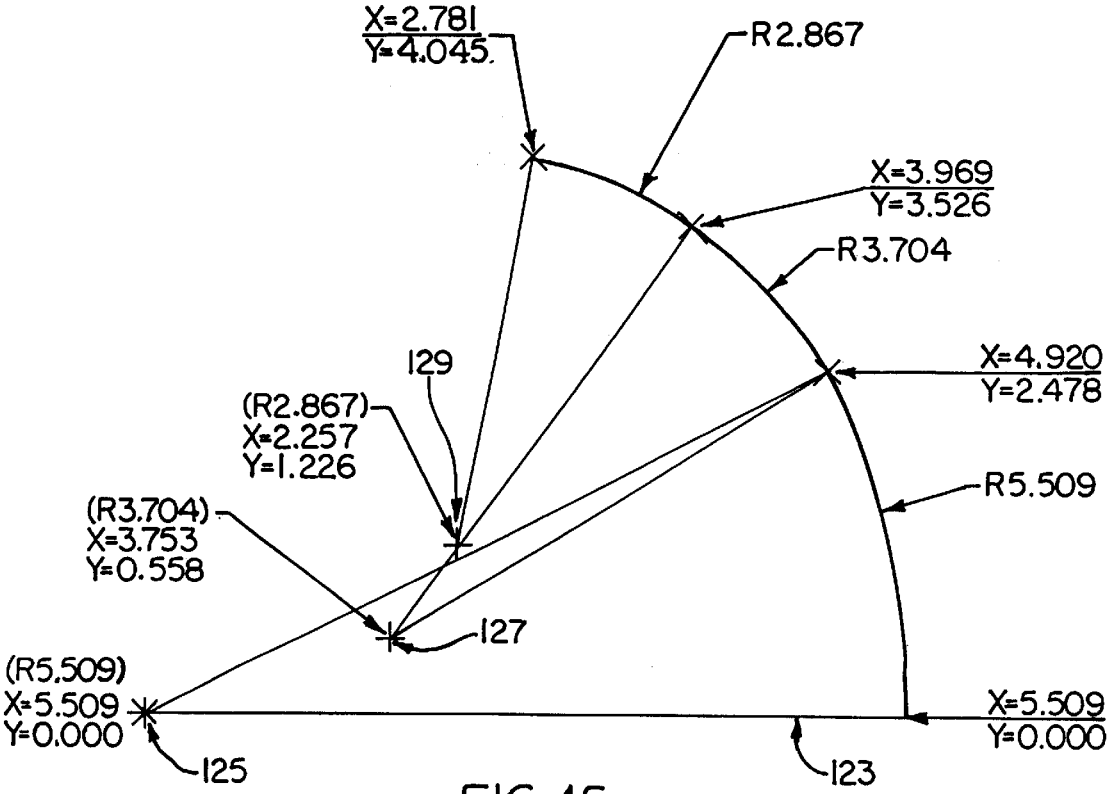
FIG. 15 is a diagram illustrating the shape of a portion of the light trap element.

While several of the figures illustrate the shape of the curved mounting flange 122, FIG. 15 diagrammatically illustrates a particular shape which is of substantial utility. FIG. 15 shows only one-half of the curve of the mounting flange 122, the flange 122 essentially being symmetrical about centerline 123. It is also to be noted that the diffuser 124, as well as the diffusers 26, 28, have an interior curvature which essentially matches the curvature of the mounting flange 122. The shape described in FIG. 15 is not only functional but is also aesthetically pleasing, this shape contributing to the quality of light and photometric performance of the fixture 10 as has been described herein.

Referring particularly to FIG. 15, a Cartesian coordinate system is established with X and Y having zero values at 125. A first point is then taken on the centerline 123 at X=5.509 and Y zero. While the dimensions can be selected as desired, the values given are effectively given in inches for the continuously changing curves forming the shape of the mounting flange 122. A radius of 5.509 is thus scribed from the (0,0) center to a point on the curve determined by a radius of 3.704 from a center having X=1.753 and Y=0.558, this center being identified as 127. The point of intersection between that portion of the curve having the center at 127 and a radius of 3.704 is thus identified by the coordinates X=4.920 and Y=2.478. A third center identified as 129 has coordinates X=2.257 and Y=1.226. A radius of 2.867 from the center 129 intersects that arc drawn from the center 127 at coordinates X=3.969 and Y=3.526. The arc drawn from the center 129 terminates at coordinates X=2.781 and Y=4.045, the curvature of at least the abutting surfaces of the mounting flange 122 and the diffusers 24, 26 and 28 being thus defined. In actuality, the diffusing sheet 106 fitted into the diffusers 24, 26 and 28 also assume the shape illustrated in FIG. 15 and is actually the structure which abuts outermost arcuate surfaces of the mounting flange 122. Of course, outermost arcuate surfaces of the diffusers 24, 26 and 28 also follow the shape illustrated in FIG. 15 in a preferred embodiment.

Figure 16:
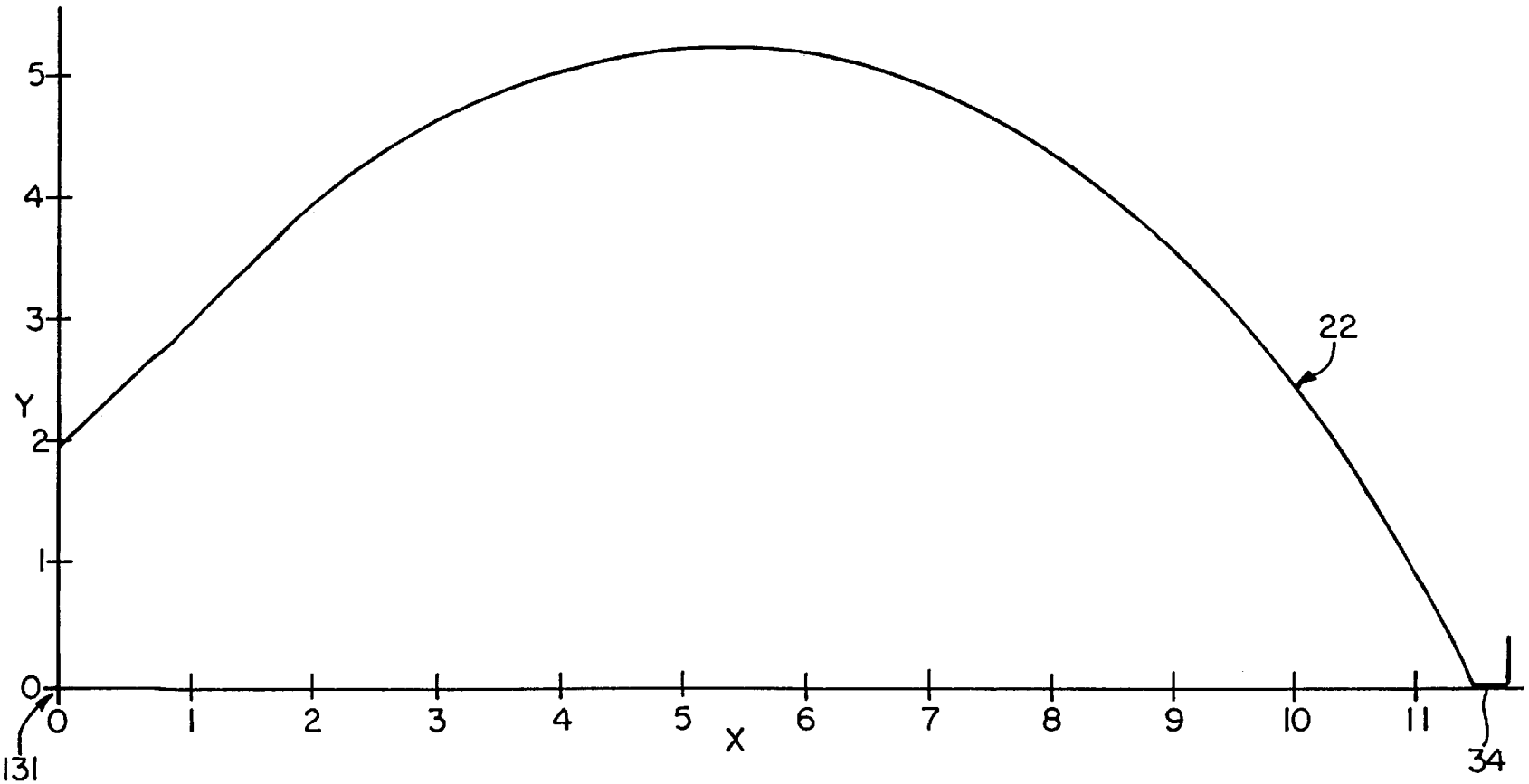
FIG. 16 is a diagram illustrating the shape of the reflector elements.

FIG. 16 diagrammatically illustrates a preferred shape of the arcuate reflectors 20, 22 as is best illustrated in a cartesian coordinate system. As illustrated, the reflector 22 is pictured with it being understood that the reflector 20 is a mirror image thereof. As seen in FIG. 16, zero coordinates in X and Y are established at 131 with the effective shape of the curve defining the reflective surfaces of the reflector 22 beginning at X and Y coordinates zero and 1.9 respectively and terminating at X and Y coordinates of 11.45 and zero respectively, dimensions being taken to be in inches. The following values of X and Y include two values indicative of the flange 34 which is provided for mechanical purposes, the X and Y values being as follows:

| X | Y |
|---|---|
| 0 | 1.9 |
| 1 | 2.92 |
| 2 | 3.9 |
| 3 | 4.6 |
| 4 | 5.03 |
| 5 | 5.23 |
| 6 | 5.2 |
| 7 | 4.95 |
| 8 | 4.43 |
| 9 | 3.63 |
| 10 | 2.55 |
| 11 | 1 |
| 11.45 | 0 |
| 11.85 | 0 |
| 11.85 | 0.4 |

Referring to FIG. 5, it is to be seen that a line taken from a surface of the reflector 22 effectively through an end point of the curvature of the shape of FIG. 15 and effectively to the outer edge of the reflector 22 establishes an angle alpha of 20° 23 minutes and 44 seconds which is a particularly effective arrangement for the relationship of the diffusers 24, 26 and 28 and the reflectors 20 and 22 within the fixture 10.

As is seen in the drawings and particularly in FIGS. 5 and 16, the arcuate shape of the reflective surfaces of the reflectors such as the reflector 22 is substantially parabolic.

Figure 20:
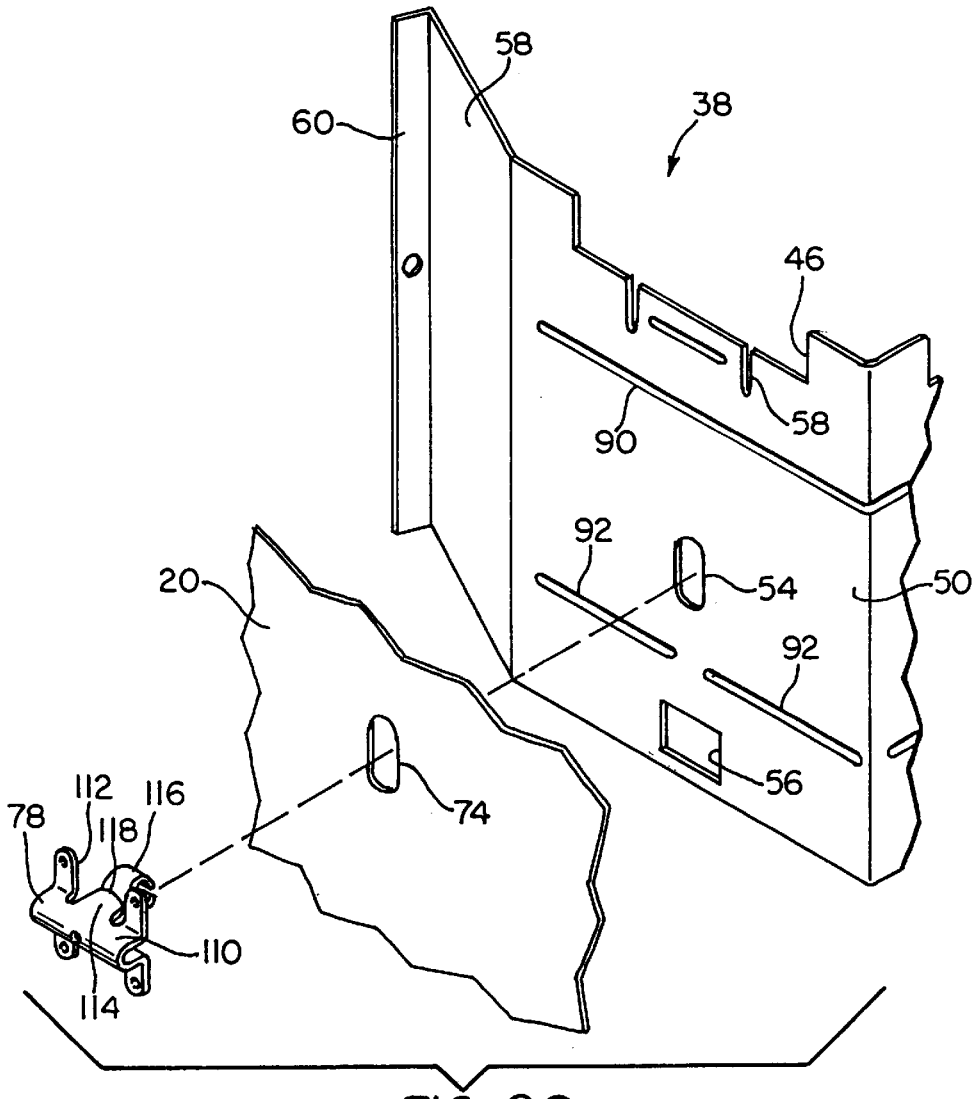
FIG. 20 is an exploded detail view illustrating connection structure for attaching the reflectors to lamp holder brackets of the housing.

Referring now to FIG. 20, a detail view is seen of one of the twist and lock fasteners 78 in relation to the reflector 20 and the bracket 38. The fastener 78 is provided with a U-shaped body portion 110 having four foot elements 112 extending two each from each side of the body portion 110. Centrally of the body portion 110 a pair of leg elements 114 extend downwardly and each terminate in recurved distal nubs 116. The leg elements 114 are inserted through the aperture 74 in the reflector 20 and then through the rounded slot 54 in the bracket 38, the aperture 74 and the slot 54 aligning on assembly of the reflector 20 the the bracket 38. The dimensions of the aperture 74 and of the slot 54 allow the nubs 116 terminating the leg elements 114 to be received through the slot 54 and the aperture 74, thereby causing the fastener 78 to loosely remain in engagement with the reflector 20 and the bracket 38. Rotation of the fastener 78 by one-quarter turn causes an upper surface 118 of each of the nubs 116 to tightly bias against inner wall portions of the plate 50 adjacent the slot 54 to tightly hold the reflector 20 in mounting engagement with the bracket 38. In the "loose fitting" arrangement of the fastener 78 within the aperture 74 and the slot 54, the lengthwise dimensions of said aperture 74 and the slot 54 do not provide surfaces against which the nubs 116 can contact, the width-wise dimensions of the aperture 74 and the slot 54 being lesser to a degree which allows contact between the surfaces 118 of the nub 116 and surfaces of the bracket 38 as described.

Figure 17:
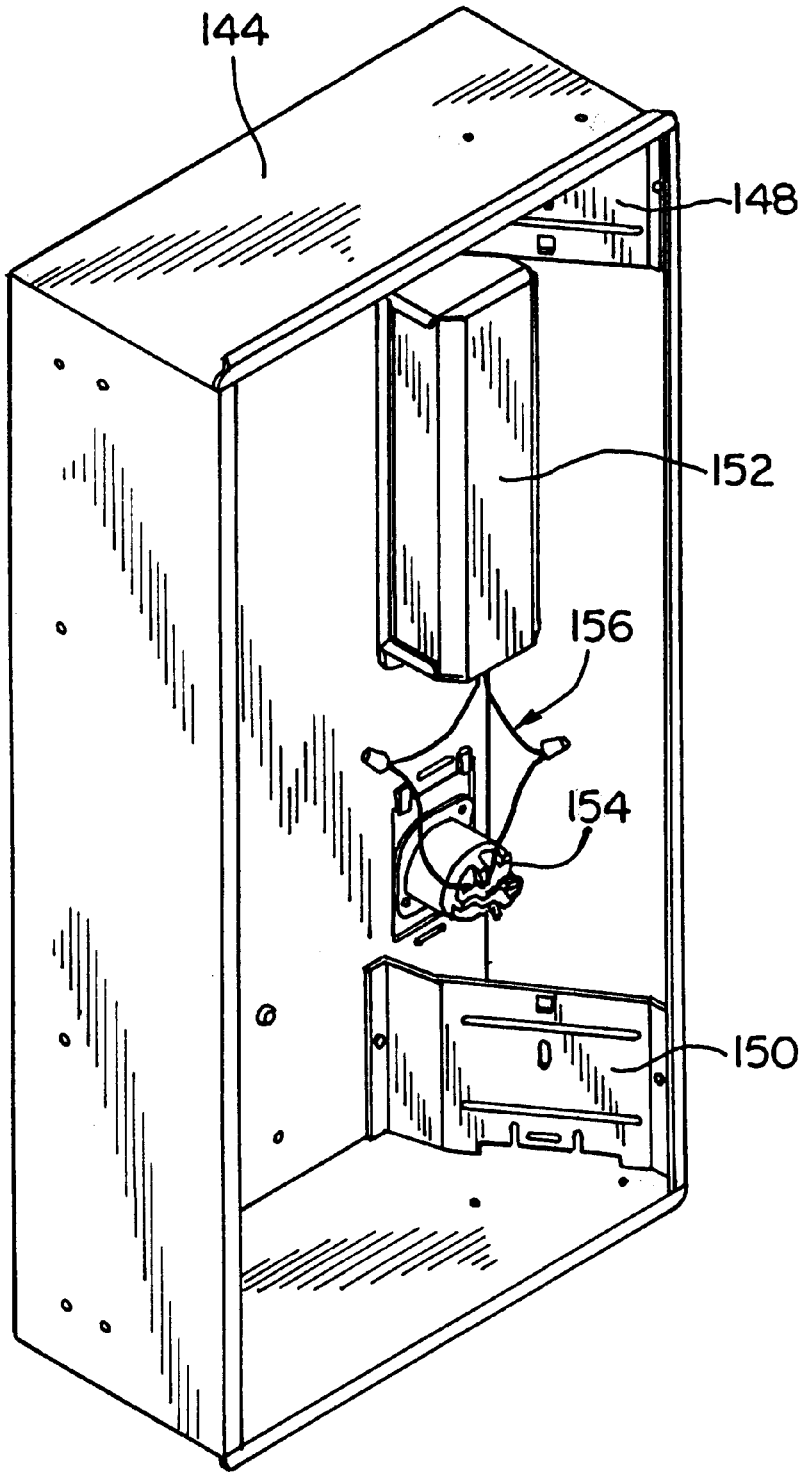
FIG. 17 is a perspective view of a housing and interior structure of a wall wash embodiment of the invention absent reflector and diffuser structures.
Figure 18:
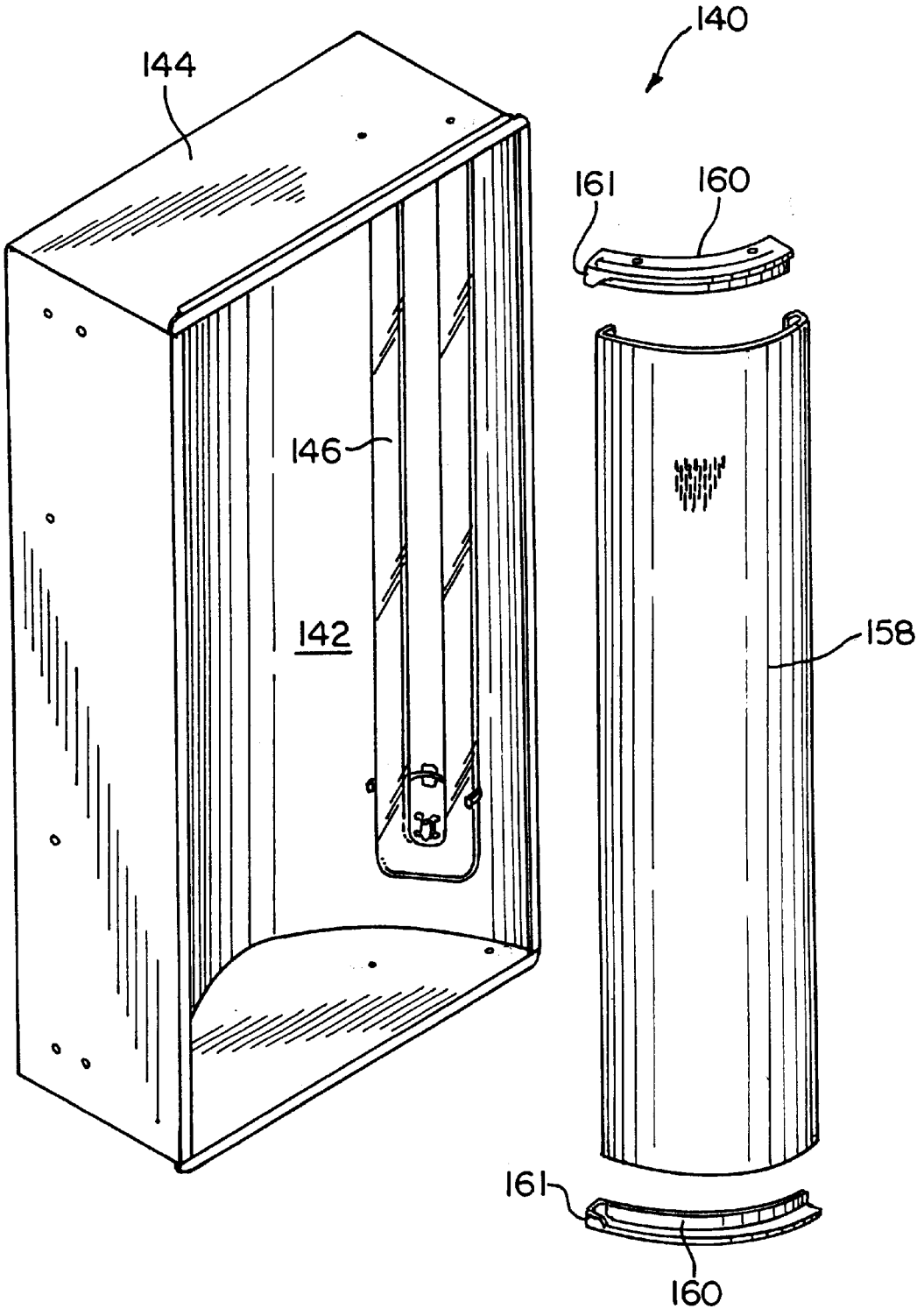
FIG. 18 is a partially exploded view illustrating the mounting relationship of the light trap elements and partial diffuser of a wall wash embodiment of the invention to a fixture housing having a reflector and illumination source mounted therein.
Figure 19:
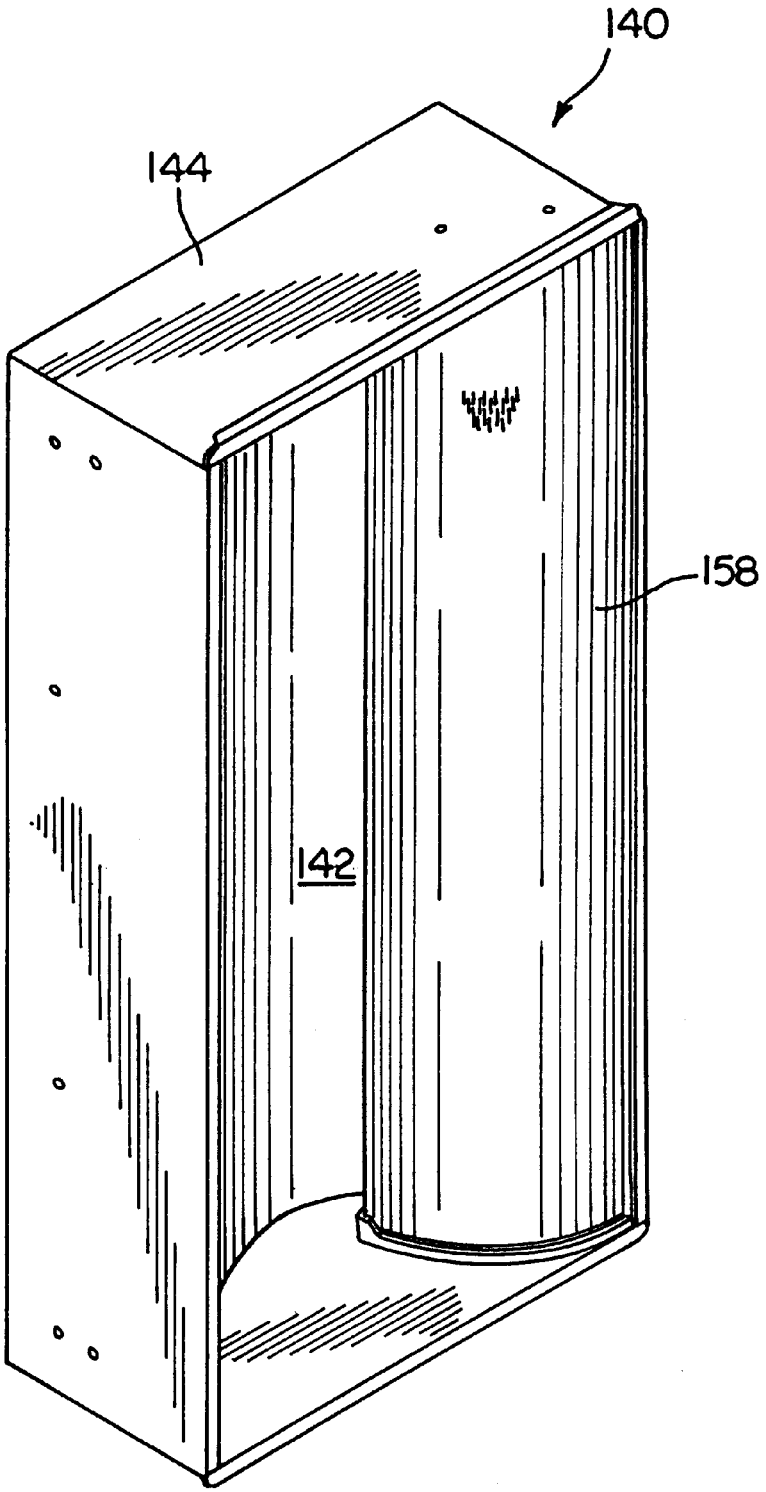
FIG. 19 is a perspective view of a fully assembled wall wash embodiment of the invention.

Referring now to FIGS. 17, 18 and 19, a wall wash lighting fixture 140 is seen in essence to comprise one-half of the lighting fixture 10 in that only a single arcuate reflector 142 is mounted within housing 144, the housing 144 being only half the width-wise dimension of the housing 12 referred to hereinabove. The wall wash lighting fixture 140 is intended to be placed near vertical wall surfaces in a pattern of lighting fixtures which include the fixtures 10 as well as the fixtures 140 or to be located in hallways of dimensions favorable for the use of the fixtures 140 to direct light particularly onto the vertical wall surfaces along such hallways. In the fixture 140, a single lamp 146 is mounted to the reflector 142 by means of a single lamp socket (not shown) which is mounted essentially identically to a lamp holder bracket 148 which effectively is formed as one-half of the lamp holder bracket 38. The lamp holder bracket 148 and a lamp holder bracket 150 which corresponds to the lamp holder bracket 40 act to mount the arcuate reflector 142 in essentially the identical way that the reflectors 20, 22 are mounted by the lamp holder brackets 38, 40. A ballast 152 and a power socket 154 are provided in the fixture 140 along with wiring 156 to perform the same functions as do the elements 62, 64 and 66 described hereinabove.

In the wall wash lighting fixture 140, a diffuser 158 is provided which is slightly greater than one-half of the diffuser 24. Light trap mounting elements 160 mount to the housing 144 and mount the diffuser 158 in a groove of each element 160, each element 160 having a tab 161 at one end thereof and being adjacent the groove to hold the diffuser 158 to the elements 160. The light trap mounting elements 160 can be simply affixed to the housing 144 such as by the use of screws (not shown) or can be mounted in a manner similar to the mounting of the light traps 36 to the fixture.

Figure 22:
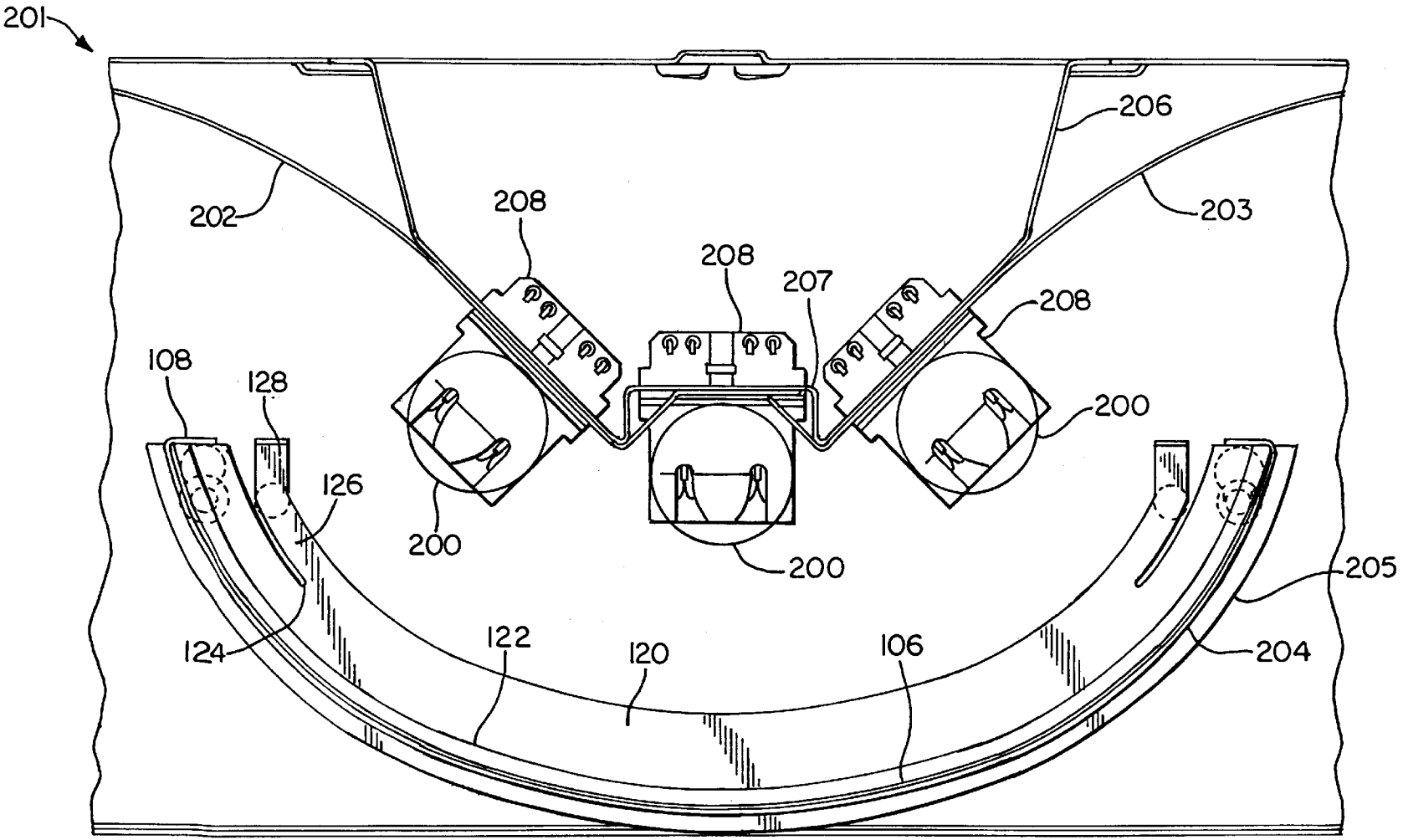
FIG. 22 is a sectional view of a rectangular embodiment of the invention.

Referring now to FIG. 22, a cross-sectional view of a further embodiment of the invention is seen to utilize T8 fluorescent lamps 200 in a fixture seen generally at 201 to comprise a luminaire having substantially the same width-wise dimensions as the lighting fixture 10 but with a greater length and in particular a fixture having a width of approximately two feet and a length of approximately four feet, the lamps 200 therefore being T8 lamps having nominal lengths of approximately four feet as is standard in the industry. In the fixture 201, three of the lamps 200 are utilized for a desired brightness level. It is to be understood that two such lamps 200 could be utilized with locations thereof being substantially identical to the locations of the lamps 68, 70 in the fixture 10. However, the arrangement of FIG. 22 illustrates that three lamps such as the lamps 200 can be fit within the confines of a region defined by reflectors 202 and 203 as well as diffuser 204 which is shaped, along with light trap mounting elements 205, as is described relative to FIG. 15.

In the fixture 201, the diffuser 204 and the light trap mounting elements 205, as well as most other structure, can be substantially identical to that corresponding structure described relative to the fixture 10, a primary exception being the length of the diffuser 204 as well as the lengths of the arcuate reflectors 202 and 203.

As can be seen in FIG. 22, lamp holder bracket 206 terminates centrally in a U-shaped yoke 207, thereby providing space for overlapping portions of the reflectors 202, 203 centrally of and within the yoke 207. Lamp holders 208 mount to either end of the fixture 201 to mount the lamps 200. A central one of the lamps 200 mounts partially into the confines of a trough formed by overlapping edge flanges of the reflectors 202, 203, the remaining lamps 200 being mounted respectively to each side of the centrally disposed lamp 200 and in locations substantially similar to the mounting of the lamps 68, 70 of the fixture 10. The three lamps 200 therefore provide greater lumen output effectively within a small region bounded by the reflectors 202, 203 and the diffuser 204 as noted above to provide an indirect/direct lighting character and quality as has been described herein.

It should be further noted that the fixture 10 could be provided with T8 lamps of the appropriate size rather than the particular compact fluorescent lamps shown and described relative to a preferred embodiment of the fixture 10 inter alia.

It should be understood that the lighting fixtures of the invention can be configured with differing dimensions than as expressly shown in the drawings. For example, lighting fixtures such as the fixture 10 can readily and easily be alternatively formed as two feet by four feet fixture using T5 bi-tube compact fluorescent lamps rather than the T8 lamps of FIG. 22. In such a fixture, a pair of the T5 lamps can be mounted at one end of the fixture with a second pair of the T5 lamps being mounted at the other end of the fixture. Reflectors corresponding to the arcuate reflectors 20, 22 would extend the full length of the fixture while a diffuser corresponding to the diffuser 24 would also extend essentially the full length of such a fixture. A wall wash lighting fixture essentially identical to the fixture 140 could also be provided having dimensions of one foot in width and four feet in length as can be readily understood from the description already provided. Accordingly, the invention can be practiced other than as explicitly described and shown herein, the scope of the invention therefore being limited only by the recitations of the appended claims.

What is claimed is:

1. A lighting fixture for illuminating by direct and indirect illumination an interior portion of an environmental space within which the fixture is mounted, comprising:

a housing open over a face thereof, the open face extending toward the interior portion of the environmental space;

reflector elements mounted by the housing and each having arcuate reflective surfaces extending from lateral edges of the housing toward a central portion thereof and each extending toward the other within said central portion, each of the reflective surfaces having a radius of curvature which is greater nearmost the respective lateral edges than centrally of the reflective surfaces, the reflective surfaces facing the open face of the housing;

a diffuser element at least portions of which are open to direct passage of light therethrough being mounted centrally of the housing and covering portions of the reflector elements disposed interiorly of the housing, the diffuser element being spaced from the reflector elements to define an illumination zone within the interior of the housing; and, illumination means for providing light output disposed within the illumination zone, portions of the light emanating from the illumination means and being incident on the diffuser element passing through the diffuser element and into the space with other portions of said light being reflected by the diffuser element to the reflector elements for reflection externally of the fixture, other portions of that light emanating from the illumination means being incident directly on the reflector elements and being substantially reflected by the fixture.

2. The lighting fixture of claim 1 and further comprising means for mounting the diffuser element within the housing.

3. The lighting fixture of claim 2 wherein the mounting means comprise means for reducing light leakage from end portions of the diffuser element at junctions with wall surfaces of the housing.

4. The lighting fixture of claim 3 wherein the mounting means further comprise means for rapid assembly and disassembly of the mounting means to and from wall surfaces of the housing.

5. The lighting fixture of claim 3 wherein the mounting means comprises an arcuate mounting flange having a shape congruent with an arcuate shape of the diffuser element, the diffuser element fitting against and to the arcuate mounting flange.

6. The lighting fixture of claim 5 wherein the shapes of the mounting flange of the mounting means and of the portions of the diffuser element fitting thereto are continuously changing curves which are symmetric about a centerline.

7. The lighting fixture of claim 6 wherein the arcuate portions of the shapes are arcs of circles having differing centers and radii, the arcs being joined at adjacent ends thereof and acting to form a concave arcuate shape with end portions thereof each being spaced from a portion of one of the reflector elements.

8. The lighting fixture of claim 1 and further comprising a bracket centrally mounted within the housing, portions of the reflector elements being juxtaposed to the bracket, the fixture further comprising at least one lamp holder mounted to the bracket adjacent each of the reflector elements to mount lamping along the respective reflector elements and within the illumination zone spaced from the diffuser element.

9. The lighting fixture of claim 8 and further comprising means for mounting the reflector elements to the bracket for rapid assembly and disassembly to and from said bracket.

10. The lighting fixture of claim 1 wherein the arcuate reflective surfaces of the reflector elements are essentially similar to a parabolic shape with concave portions thereof facing the open face of the housing.

11. The lighting fixture of claim 1 wherein a shielding angle of the fixture taken as an angle between an uppermost edge of the diffuser element and a lowermost portion of one of the reflector elements and the plane in which the opening lies is approximately 23°.

12. The lighting fixture of claim 1 wherein the diffuser element has a plurality of longitudinally disposed slots formed therein.

13. The lighting fixture of claim 1 wherein the diffuser element has a plurality of circular apertures formed therein.

14. The lighting fixture of claim 1 and further comprising a diffusing sheet fitted to innermost surfaces of the diffuser element.

15. The lighting fixture of claim 1 wherein the illumination means comprise at least one compact fluorescent lamp.

16. The lighting fixture of claim 1 wherein the illumination means comprise at least one elongated fluorescent lamp.

17. The lighting fixture of claim 1 wherein the illumination means comprises a centrally disposed elongated fluorescent lamp located centrally of the housing and having at least one other elongated fluorescent lamp located laterally thereof.

18. A lighting fixture for illuminating by direct and indirect illumination an interior portion of an environmental space within which the fixture is mounted, comprising:

a housing open over a face thereof, the open face extending toward the interior portion of the environmental space;

a reflector element mounted by the housing and having arcuate reflective surfaces extending from a lateral edge of the housing and toward a second lateral edge thereof, the reflective surfaces facing the open face of the housing;

a diffuser element at least portions of which are open to direct passage of light therethrough being mounted over the other lateral edge of the housing and covering portions of the reflector elements located in proximity thereto, the diffuser element being spaced from the reflector element to define an illumination zone within the housing; and, illumination means for providing light output disposed within the illumination zone.

19. The lighting fixture of claim 18 and further comprising means for mounting the diffuser element within the housing, the mounting means comprising means for reducing light leakage from end portions of the diffuser element at junctures with wall surfaces of the housing, the mounting means comprising an arcuate mounting flange having a shape congruent with an arcuate shape of the diffuser element, the diffuser element fitting against and to the arcuate mounting flange.

20. The lighting fixture of claim 18 and further comprising a diffusing sheet fitted to innermost surfaces of the diffuser element.

21. A lighting fixture, comprising:

a housing open over a face thereof, the open face extending toward an interior portion of an environmental space within which the fixture is mounted for illumination thereof;

reflector elements mounted by the housing and each having arcuate reflective surfaces extending from lateral edges of the housing toward a central portion thereof, the reflective surfaces facing the open face of the housing;

a diffuser element being mounted centrally of the housing and covering portions of the reflector elements disposed interiorly of the housing, the diffuser element being spaced from the reflector elements to define an illumination zone within the interior of the housing;

illumination means for providing light output disposed within the illumination zone, portions of the light emanating from the illumination means and being incident on the diffuser element passing through the diffuser element and into the space with other portions of said light being reflected to the reflector elements for reflection externally of the fixture, other portions of that light emanating from the illumination means being incident directly on the reflector elements and being substantially reflected by the fixture; and, means for mounting the diffuser element within the housing and comprising means for reducing light leakage from end portions of the diffuser element at junctions with wall surfaces of the housing, the mounting means comprising an arcuate mounting flange having a shape congruent with an arcuate shape of the diffuser element, the diffuser element fitting against and to the arcuate mounting flange.

22. The lighting fixture of claim 21 wherein the shapes of the mounting flange of the mounting means and of the portions of the diffuser element fitting thereto are continuously changing curves which are symmetric about a centerline.

23. The lighting fixture of claim 22 wherein the arcuate portions of the shapes are arcs of circles having differing centers and radii, the arcs being joined at adjacent ends thereof and acting to form a concave arcuate shape with end portions thereof each being spaced from a portion of one of the reflector elements.

24. The lighting fixture of claim 21 and further comprising a bracket centrally mounted within the housing, portions of the reflector elements being juxtaposed to the bracket, the fixture further comprising at least one lamp holder mounted to the bracket adjacent each of the reflector elements to mount lamping along the respective reflector elements and within the illumination zone spaced from the diffuser element.

25. The lighting fixture of claim 24 and further comprising means for mounting the reflector elements to the bracket for rapid assembly and disassembly to and from said bracket.

26. The lighting fixture of claim 21 wherein the arcuate reflective surfaces of the reflector elements are essentially similar to a parabolic shape with concave portions thereof facing the open face of the housing.

27. The lighting fixture of claim 21 wherein a shielding angle of the fixture taken as an angle between an uppermost edge of the diffuser element and a lowermost portion of one of the reflector elements and the plane in which the opening lies is approximately 23°.

28. The lighting fixture of claim 21 wherein the diffuser element has a plurality of longitudinally disposed slots formed therein.

29. The lighting fixture of claim 21 wherein the diffuser element has a plurality of circular apertures formed therein.

30. The lighting fixture of claim 21 wherein the diffuser element has prisms formed on at least one surface thereof.

31. The lighting fixture of claim 21 and further comprising a diffusing sheet fitted to innermost surfaces of the diffuser element.

32. The lighting fixture of claim 21 wherein the illumination means comprise at least one compact fluorescent lamp.

33. The lighting fixture of claim 21 wherein the illumination means comprise at least one elongated fluorescent lamp.

34. The lighting fixture of claim 21 wherein the illumination means comprise a centrally disposed elongated fluorescent lamp located centrally of the housing and having at least one other elongated fluorescent lamp located laterally thereof.

35. A lighting fixture, comprising:

a housing open over a face thereof, the open face extending toward an interior portion of an environmental space within which the fixture is mounted for illumination thereof;

reflector elements mounted by the housing and each having arcuate reflective surfaces extending from lateral edges of the housing toward a central portion thereof, the reflective surfaces facing the open face of the housing;

a diffuser element being mounted centrally of the housing and covering portions of the reflector elements disposed interiorly of the housing, the diffuser element being spaced from the reflector elements to define an illumination zone within the interior of the housing;

illumination means for providing light output disposed within the illumination zone, portions of the light emanating from the illumination means and being incident on the diffuser element passing through the diffuser element and into the space with other portions of said light being reflected to the reflector elements for reflection externally of the fixture, other portions of that light emanating from the illumination means being incident directly on the reflector elements and being substantially reflected by the fixture; and, a bracket centrally mounted within the housing, portions of the reflector elements being juxtaposed to the bracket, the fixture further comprising at least one lamp holder mounted to the bracket adjacent each of the reflector elements to mount lamping along the respective reflector elements and within the illumination zone spaced from the diffuser element.

36. The lighting fixture of claim 35 and further comprising means for mounting the reflector elements to the bracket for rapid assembly and disassembly to and from said bracket.

37. The lighting fixture of claim 35 wherein the arcuate reflective surfaces of the reflector elements are essentially similar to a parabolic shape with concave portions thereof facing the open face of the housing.

38. The lighting fixture of claim 35 wherein a shielding angle of the fixture taken as an angle between an uppermost edge of the diffuser element and a lowermost portion of one of the reflector elements and the plane in which the opening lies is approximately 23°.

39. The lighting fixture of claim 35 and further comprising a diffusing sheet fitted to innermost surfaces of the diffuser element.

40. A lighting fixture, comprising:

a housing open over a face thereof, the open face extending toward an interior portion of an environmental space within which the fixture is mounted for illumination thereof;

reflector elements mounted by the housing and each having arcuate reflective surfaces extending from lateral edges of the housing toward a central portion thereof, the reflective surfaces facing the open face of the housing;

a diffuser element being mounted centrally of the housing and covering portions of the reflector elements disposed interiorly of the housing, the diffuser element being spaced from the reflector elements to define an illumination zone within the interior of the housing;

illumination means for providing light output disposed within the illumination zone, portions of the light emanating from the illumination means and being incident on the diffuser element passing through the diffuser element and into the space with other portions of said light being reflected to the reflector elements for reflection externally of the fixture, other portions of that light emanating from the illumination means being incident directly on the reflector elements and being substantially reflected by the fixture; and, a diffusing sheet fitted to innermost surfaces of the diffuser element.

41. The lighting fixture of claim 40 and further comprising means for mounting the diffuser element within the housing.

42. The lighting fixture of claim 41 wherein the mounting means comprise means for reducing light leakage from end portions of the diffuser element at junctions with wall surfaces of the housing.

43. The lighting fixture of claim 42 wherein the mounting means comprises an arcuate mounting flange having a shape congruent with an arcuate shape of the diffuser element, the diffuser element fitting against and to the arcuate mounting flange.

44. The lighting fixture of claim 43 wherein the shapes of the mounting flange of the mounting means and of the portions of the diffuser element fitting thereto are continuously changing curves which are symmetric about a centerline.

45. The lighting fixture of claim 44 wherein the arcuate portions of the shapes are arcs of circles having differing centers and radii, the arcs being joined at adjacent ends thereof and acting to form a concave arcuate shape with end portions thereof each being spaced from a portion of one of the reflector elements.

46. The lighting fixture of claim 40 wherein the arcuate reflective surfaces of the reflector elements are essentially similar to a parabolic shape with concave portions thereof facing the open face of the housing.

47. The lighting fixture of claim 40 wherein a shielding angle of the fixture taken as an angle between an uppermost edge of the diffuser element and a lowermost portion of one of the reflector elements and the plane in which the opening lies is approximately 23°.

48. The lighting fixture of claim 40 wherein the diffuser element has a plurality of longitudinally disposed slots formed therein.

49. The lighting fixture of claim 40 wherein the diffuser element has a plurality of circular apertures formed therein.

50. The lighting fixture of claim 40 wherein the diffuser element has prisms formed on at least one surface thereof.

51. A lighting fixture, comprising:

a housing open over a face thereof, the open face extending toward an interior portion of an environmental space within which the fixture is mounted for illumination thereof;

reflector elements mounted by the housing and each having arcuate reflective surfaces extending from lateral edges of the housing toward a central portion thereof, the reflective surfaces facing the open face of the housing;

a diffuser element being mounted centrally of the housing and covering portions of the reflector elements disposed interiorly of the housing, the diffuser element being spaced from the reflector elements to define an illumination zone within the interior of the housing; and, illumination means for providing light output disposed within the illumination zone, portions of the light emanating from the illumination means and being incident on the diffuser element passing through the diffuser element and into the space with other portions of said light being reflected to the reflector elements for reflection externally of the fixture, other portions of that light emanating from the illumination means being incident directly on the reflector elements and being substantially reflected by the fixture, the illumination means comprising a centrally disposed elongated fluorescent lamp located centrally of the housing and having at least one other elongated fluorescent lamp located laterally thereof.

52. The lighting fixture of claim 51 wherein the arcuate reflective surfaces of the reflector elements are essentially similar to a parabolic shape with concave portions thereof facing the open face of the housing.

53. The lighting fixture of claim 51 wherein a shielding angle of the fixture taken as an angle between an uppermost edge of the diffuser element and a lowermost portion of one of the reflector elements and the plane in which the opening lies is approximately is approximately 23°.

54. The lighting fixture of claim 51 and further comprising a diffusing sheet fitted to innermost surfaces of the diffuser element.

55. A lighting fixture, comprising:

a housing open over a face thereof, the open face extending toward an interior portion of an environmental space within which the fixture is mounted for illumination thereof;

a reflector element mounted by the housing and having arcuate reflective surfaces extending from a lateral edge of the housing and toward a second lateral edge thereof, the reflective surfaces facing the open face of the housing;

a diffuser element being mounted over the other lateral edge of the housing and covering portions of the reflector element located in proximity thereto, the diffuser element being spaced from the reflector element to define an illumination zone within the housing;

illumination means for providing light output disposed within the illumination zone; and, means for mounting the diffuser element within the housing, the mounting means comprising means for reducing light leakage from end portions of the diffuser element at junctures with wall surfaces of the housing, the mounting means comprising an arcuate mounting flange having a shape congruent with an arcuate shape of the diffuser element, the diffuser element fitting against and to the arcuate mounting flange.

* * * * *